US012208951B1

(12) United States Patent
Chaykin et al.

(10) Patent No.: US 12,208,951 B1
(45) Date of Patent: Jan. 28, 2025

(54) WINGED CONTAINER PACKAGING SYSTEM AND METHODS OF MAKING AND USING SAME

(71) Applicant: Oblige, LLC, Seattle, WA (US)

(72) Inventors: Benjamin Chaykin, Seattle, WA (US); Connor Cararra, Seattle, WA (US); Ian O'Brien, Seattle, WA (US)

(73) Assignee: Oblige, LLC, Seattle, WA (US)

( * ) Notice: Subject to any disclaimer, the term of this patent is extended or adjusted under 35 U.S.C. 154(b) by 0 days.

(21) Appl. No.: 18/183,148

(22) Filed: Mar. 13, 2023

Related U.S. Application Data

(63) Continuation-in-part of application No. 29/867,963, filed on Nov. 15, 2022, and a continuation-in-part of application No. 29/792,895, filed on Apr. 29, 2022, now Pat. No. Des. 1,045,589.

(60) Provisional application No. 63/269,303, filed on Mar. 14, 2022.

(51) Int. Cl.
*B65D 73/00* (2006.01)

(52) U.S. Cl.
CPC ..... *B65D 73/005* (2013.01)

(58) Field of Classification Search
CPC ..... B65D 73/005; B65D 73/0007; B65D 73/0042; B65D 73/0064; B65D 73/0014; B65D 73/0021
USPC ..... 206/495, 806, 489, 461, 462, 463, 471
See application file for complete search history.

(56) References Cited

U.S. PATENT DOCUMENTS

| | | | | |
|---|---|---|---|---|
| 3,908,827 | A * | 9/1975 | Bemmels | B65D 73/005 206/478 |
| 5,392,919 | A * | 2/1995 | Passamoni | B65D 73/0085 206/576 |
| 7,735,678 | B2 * | 6/2010 | Rushe | B65D 1/32 220/837 |
| 8,136,665 | B2 * | 3/2012 | Van Marle | B65D 73/0021 426/115 |
| 9,061,812 | B1 * | 6/2015 | Loritz | B65D 43/22 |
| 11,069,262 | B2 * | 7/2021 | Kunreuther | G09F 1/04 |

OTHER PUBLICATIONS

Notice of Allowance, dated Jun. 27, 2024, 5 pages, received in U.S. Appl. No. 29/867,963.
Notice of Allowance, dated Jun. 6, 2024, 5 pages, received in U.S. Appl. No. 29/792,895.

* cited by examiner

*Primary Examiner* — Steven A. Reynolds
(74) *Attorney, Agent, or Firm* — AVEK IP, LLC

(57) ABSTRACT

A container packaging system. The container packaging system includes a container having a body and wings. The wings are coupled to the body at a joint that terminates at a junction. The system includes a mounting device having a front face, a rear face, and a slot. The slot includes a top end and a bottom end, a first flap, and a second flap. Each of the first flap and the second flap is configured to pivot when the body is passed through the slot. When the container is removably coupled to the mounting device: (a) the body faces one of the front face and the rear face and the wings face the other of the front face and the rear face; (b) the first flap and the second flap are in contact with the body; and (c) the junction is in contact with the bottom end.

17 Claims, 27 Drawing Sheets

WINGED CONTAINER PACKAGING SYSTEM AND METHODS OF MAKING AND USING SAME

RELATED APPLICATIONS

This application claims priority to U.S. Provisional Application No. 63/269,303, filed Mar. 14, 2022. This application is also a continuation-in-part of and claims priority to U.S. Design application Ser. No. 29/867,963, filed Nov. 15, 2022, and U.S. Design application Ser. No. 29/792,895, filed Apr. 29, 2022. The disclosure of each of these applications is incorporated herein by reference in their entireties.

FIELD OF THE DISCLOSURE

The disclosure relates generally to the field of packaging systems. More specifically, the disclosure relates to a slotted mounting device for receiving and retaining a winged container.

BRIEF SUMMARY OF INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

In some aspects, the techniques described herein relate to a container packaging system. The container packaging system includes a container having a body and wings. The wings are coupled to the body at a joint that terminates at a junction. The system includes a mounting device having a front face, a rear face, and a slot. The slot includes a top end and a bottom end, and a first flap and a second flap spaced apart from the first flap. Each of the first flap and the second flap is configured to pivot when the body is passed through the slot. When the container is removably coupled to the mounting device: (a) the body faces one of the front face and the rear face and the wings face the other of the front face and the rear face; (b) the first flap and the second flap are in contact with the body; and (c) the junction is in contact with the bottom end.

In some aspects, the techniques described herein relate to a container packaging system, further including a pivotable third flap extending from the top end.

In some aspects, the techniques described herein relate to a container packaging system, wherein the slot defines a void including a funnel-shaped portion.

In some aspects, the techniques described herein relate to a container packaging system, wherein the funnel-shaped portion includes a stem and a mouth.

In some aspects, the techniques described herein relate to a container packaging system, wherein the third flap is spaced apart from the body when the container is removably coupled to the mounting device.

In some aspects, the techniques described herein relate to a container packaging system, wherein the mounting device includes a hanging feature configured for hanging the mounting device.

In some aspects, the techniques described herein relate to a container packaging system, wherein the container is a pop top container.

In some aspects, the techniques described herein relate to a container packaging system, wherein the container is suspended from the mounting device.

In some aspects, the techniques described herein relate to a container packaging system, wherein the junction extends along at least a portion of a length of the body.

In some aspects, the techniques described herein relate to a container packaging system that includes a container having a body and wings. The wings are coupled to the body at a joint. The joint terminates at a junction. The container packaging system includes a mounting device having a front face, a rear face, and a slot. The slot includes a plurality of pivotable flaps. At least one of the plurality of pivotable flaps is configured to pivot from an original position and contact the body when the container is removably coupled to the mounting device. When the container is removably coupled to the mounting device, the body faces one of the front face and the rear face and the wings face the other of the front face and the rear face.

In some aspects, the techniques described herein relate to a container packaging system, wherein the plurality of pivotable flaps includes two opposing flaps that define a generally funnel-shaped void.

In some aspects, the techniques described herein relate to a container packaging system, wherein: the plurality of pivotable flaps includes three flaps; and only two of the three flaps are displaced from their respective original positions when the container is removably coupled to the mounting device.

In some aspects, the techniques described herein relate to a container packaging system, wherein the wings are generally rectangular.

In some aspects, the techniques described herein relate to a container packaging system, wherein the at least one of the plurality of pivotable flaps has a chamfered edge.

In some aspects, the techniques described herein relate to a container packaging system, wherein the container is configured to audibly snap to the mounting device.

In some aspects, the techniques described herein relate to a container packaging system, wherein the container body is tubular and includes a pop top lid.

In some aspects, the techniques described herein relate to a method of removably coupling a container to a mounting device. The container has a body and wings. The wings are coupled to the body via a joint that terminates at a junction. The mounting device has a slot. The slot includes two pivotable flaps. The method includes passing the body through the slot to cause the two pivotable flaps to pivot from an original position and contact the body, and causing the junction to contact a lower end of the slot such that the container is suspended from the mounting device.

In some aspects, the techniques described herein relate to a method, wherein the two pivotable flaps oppose each other.

In some aspects, the techniques described herein relate to a method, further including a third pivotable flap.

In some aspects, the techniques described herein relate to a method, wherein the two pivotable flaps extend from a lower end of the slot and the third pivotable flap extends from an upper end of the slot.

BRIEF DESCRIPTION OF THE SEVERAL VIEWS OF THE DRAWINGS

Illustrative embodiments of the present disclosure are described in detail below with reference to the attached drawing figures.

DETAILED DESCRIPTION

Figure 1:
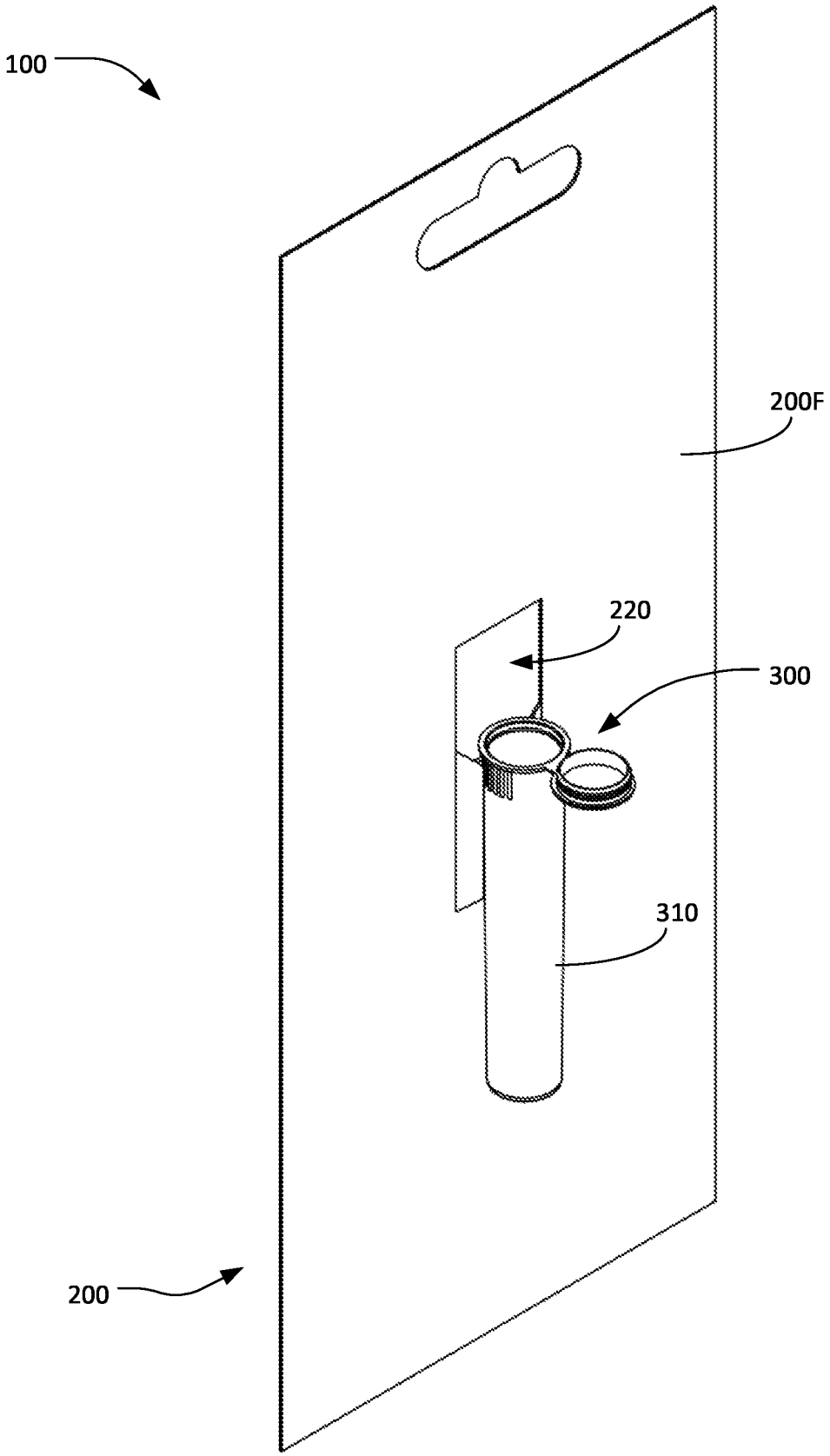
FIG. 1 is a perspective view of a winged container packaging system, according to an embodiment of the disclosure.

Product packaging systems are known in the art. A product packaging system may retain a product for sale or may retain a container within which the saleable product is housed. The prior art packaging systems may comprise wire twist ties, clasps, bands, blister shells, et cetera, configured to maintain the product or product container with the packaging. The consumer may disassociate the product and/or the container from the packaging system for use, e.g., by untwisting the twist ties, cutting the clasps, et cetera.

The prior art packaging systems, while often adequate for packaging a product, are not without problems. Some prior art packaging systems may have intensive manufacturing requirements, e.g., may require heat sealing, crimping, or other such processes that require an unsuitably long time to effectuate, and thus, lead to unjustified costs. Other prior art packaging systems may require an unsuitably large amount of material (e.g., shrink wrapped cardboard boxes), fail to properly secure the product to the packaging (e.g., twist tie packaging systems), be difficult for the end user to navigate or require tools for disassociating the product from the packaging (e.g., clamshell and blister packages), and/or be plagued with other such problems. Further, many prior art packaging systems may provide little to no advertisement opportunity, which may be undesirable. The container packaging system of the present disclosure may alleviate or at least mitigate such problems FIGS. 1-21 depict an embodiment 100 of a winged container packaging system and components thereof. The packaging system 100 may comprise a slotted mounting device 200 configured to securely retain a container, such as a winged container or receptacle 300. The winged container packaging system 100 may also be referred to herein as a receptacle suspension system. The slotted mounting device 200 may also be referred to herein as a hang tab system, a hanging package, or a holder. As discussed herein, the slotted mounting device 200 may be configured to removably retain the winged container 300. In some aspects, the winged container 300 may be suspendably retained by the mounting device 200.

Figure 9:
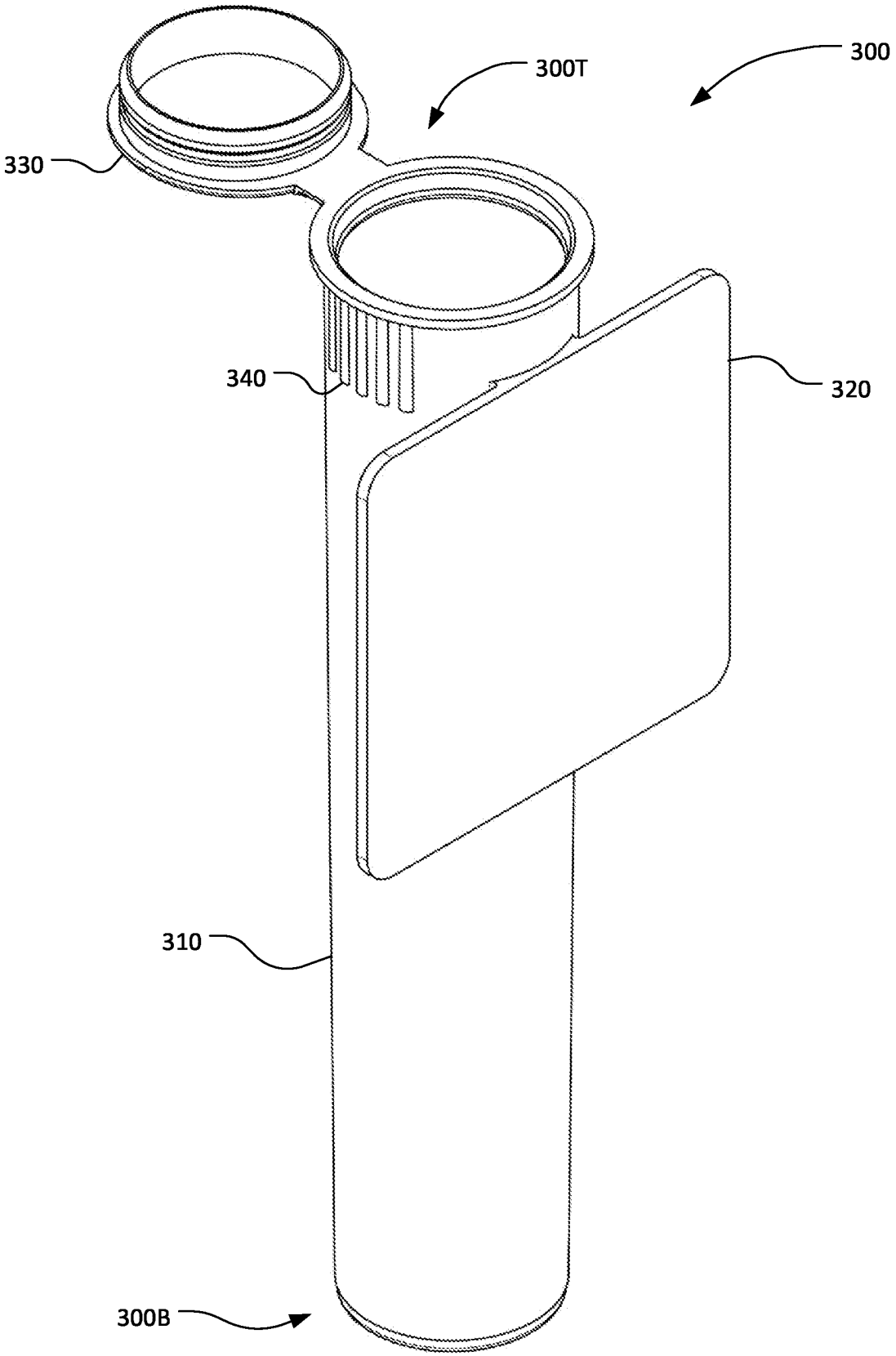
FIG. 9 is a perspective view of a winged container of the winged container packaging system of FIG. 1, shown here without the winged container, according to an embodiment of the disclosure.

The container 300 may have a body 310 and wings 320 that extend from the body 310 (see FIG. 9). FIGS. 1-8 show the winged container 300 secured to the mounting device 200 in an assembled configuration. FIGS. 9-16 show the winged container 300 in more detail, without the mounting device 200. And FIGS. 17-21 shows the slotted mounting device 200 in more detail, without the winged container 300 assembled therewith. As discussed herein, in the assembled configuration, the winged container 300 may be suspended from the slotted mounting device 200 such that the mounting device 200 extends between the container body 310 and the wings 320. The packaging system 100 may be easily assembled in a matter of seconds, and the assembled system 100 may be hung or placed on a shelf for display. The mounting device 200 may provide ample real estate for indicia to be provided, e.g., for marketing, outlining directions for use, et cetera.

Attention is now directed to FIGS. 9-16. The container 300 may comprise a container body 310 having a top side 300T and a bottom side 300B, wings 320 (also referred to herein as "flanges" or "tabs"), a lid 330, and features 340.

The body 310 may be any suitable container body now known or subsequently developed that is configured to retain a product or products for use (e.g., for sale and/or consumption). The product(s) stored in the container 300 may be any suitable product, and may take on any form (e.g., the product may be a solid, a liquid, a gas, and/or a combination thereof). For example, the container body 310 and the lid 330 may be collectively configured to securely retain e-cigarette cartridges or liquid, medicinal pills, candy, personal hygiene equipment, toys, tools, et cetera.

In the illustrated embodiment, the container 300 is a child proof container having a pop top lid 330. However, embodiments of the container 300 may be sized and/or shaped differently than what is specifically depicted in the figures to accommodate a desired product. For example, wings may be added to a conventional pill bottle container and this winged pill bottle may be secured to a slotted mounting device to form a packaging system as described herein. As another example, while the figures show the container 300 having a generally cylindrical, elongated body 310 and a pop top lid 330, the container may instead have a body in the shape of a cuboid and have a different type of lid or be devoid of a lid altogether; wings may be provided on this container body to allow the container to be packaged with a slotted mounting device. The artisan would thus understand that the packaged product and the resulting size/shape of the container 300 may be readily adapted to a desired packaging application, and that such adaptations are contemplated herein and within the scope of the disclosure.

The wings 320 may be protrusions which extend from the container body 310. The wings 320 may be proximate the top side 300T, the bottom side 300B, or extend from the body 310 between the top side 300T and the bottom side 300B. In some embodiments, the wings may extend above the top side 300T of the body 310 and/or below the bottom side 300B thereof.

The wings 320 may be integrally formed with the body 310. For example, the container 300 may have a plastic body 310 and plastic wings 320 formed therewith. Alternately, the wings 320 may be formed separately from the body 310 and later attached to the body 310 using, for example, adhesives (e.g., glue, epoxy, tape), fasteners (e.g., nails, bolts, screws), molding processes (e.g., overmolding), et cetera. Having a separately formed set of wings 320 for the container body 310 may be advantageous where a user desires to retrofit preexisting containers for use with the mounting device 200. In these embodiments, the user may fixedly or removably secure the wings 320 to the preexisting container to form the container 300 for packaging with the slotted mounting device 200.

Figure 10:
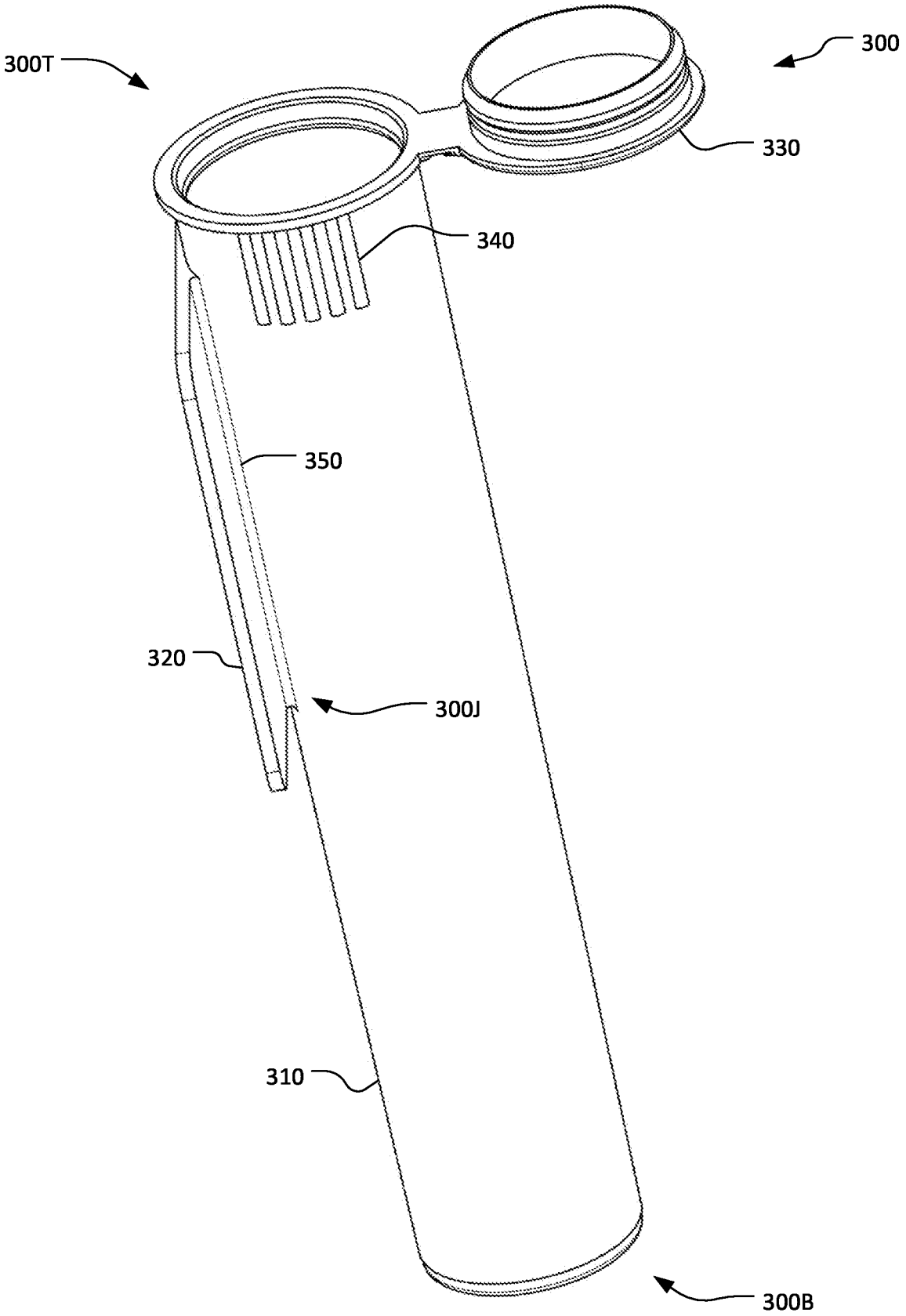
FIG. 10 is another perspective view of the winged container of FIG. 9.
Figure 11:
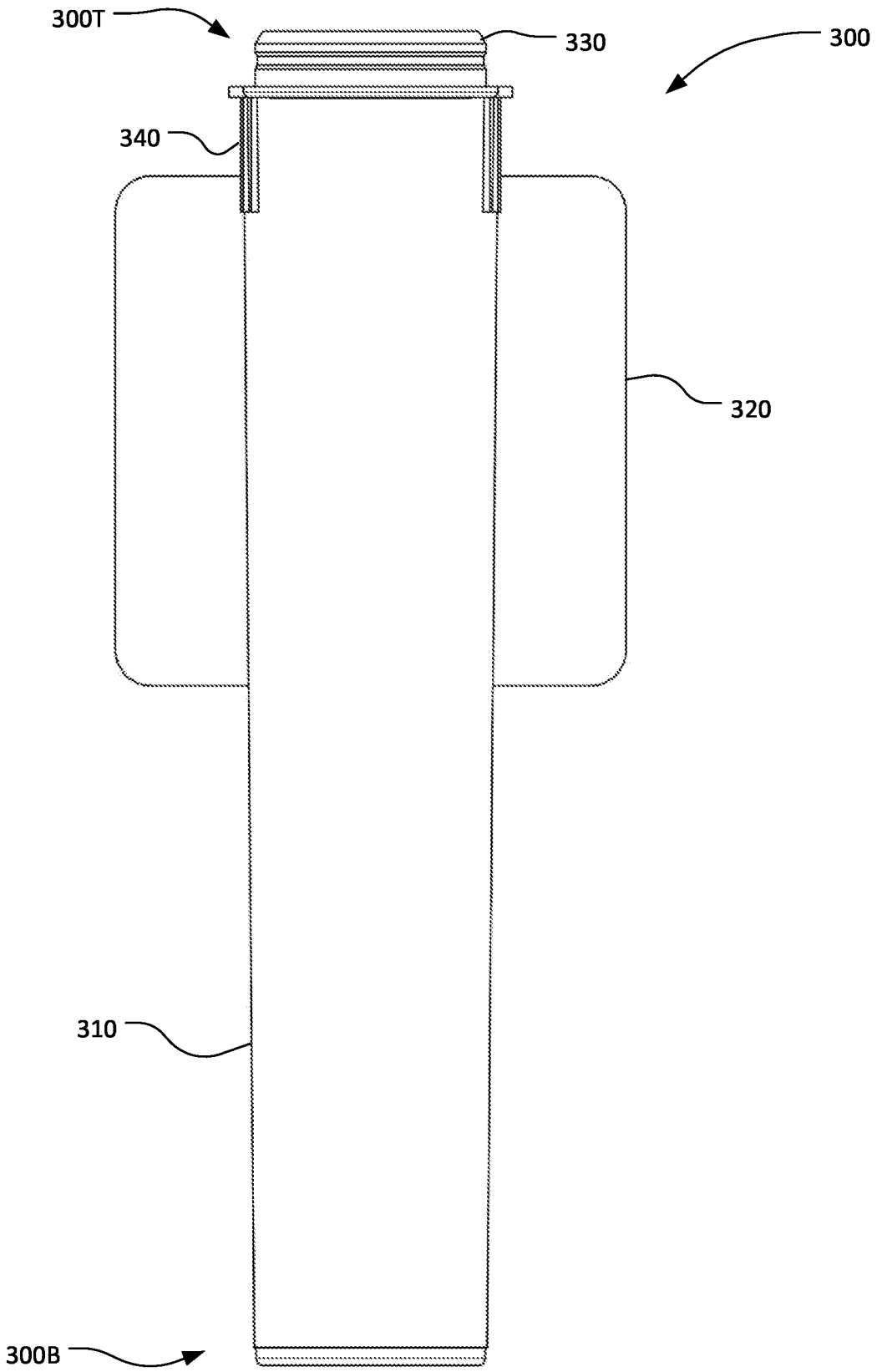
FIG. 11 is a front view of the winged container of FIG. 9.
Figure 12:
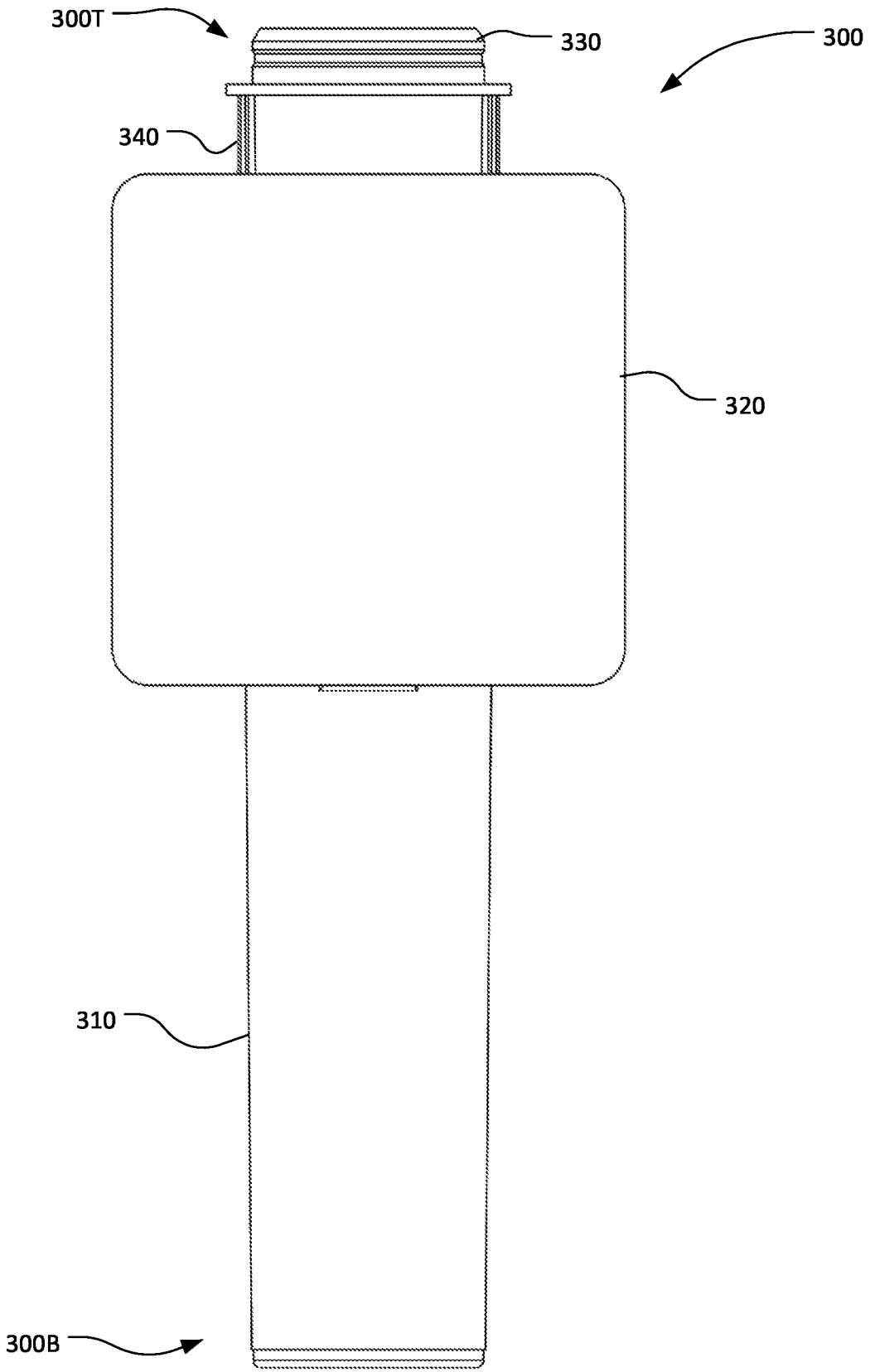
FIG. 12 is a rear view of the winged container of FIG. 9.
Figure 13:
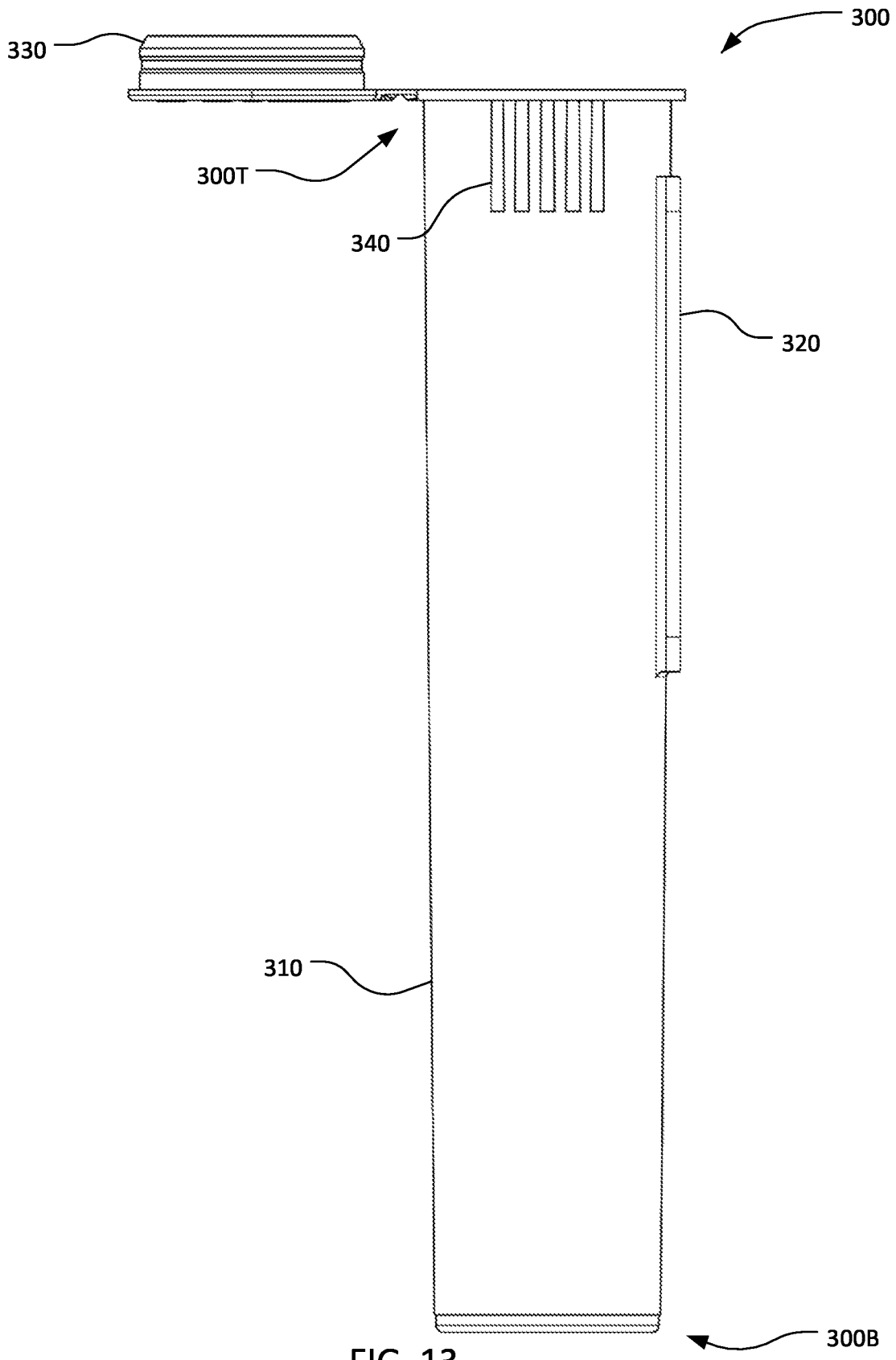
FIG. 13 is a side view of the winged container of FIG. 9.
Figure 14:
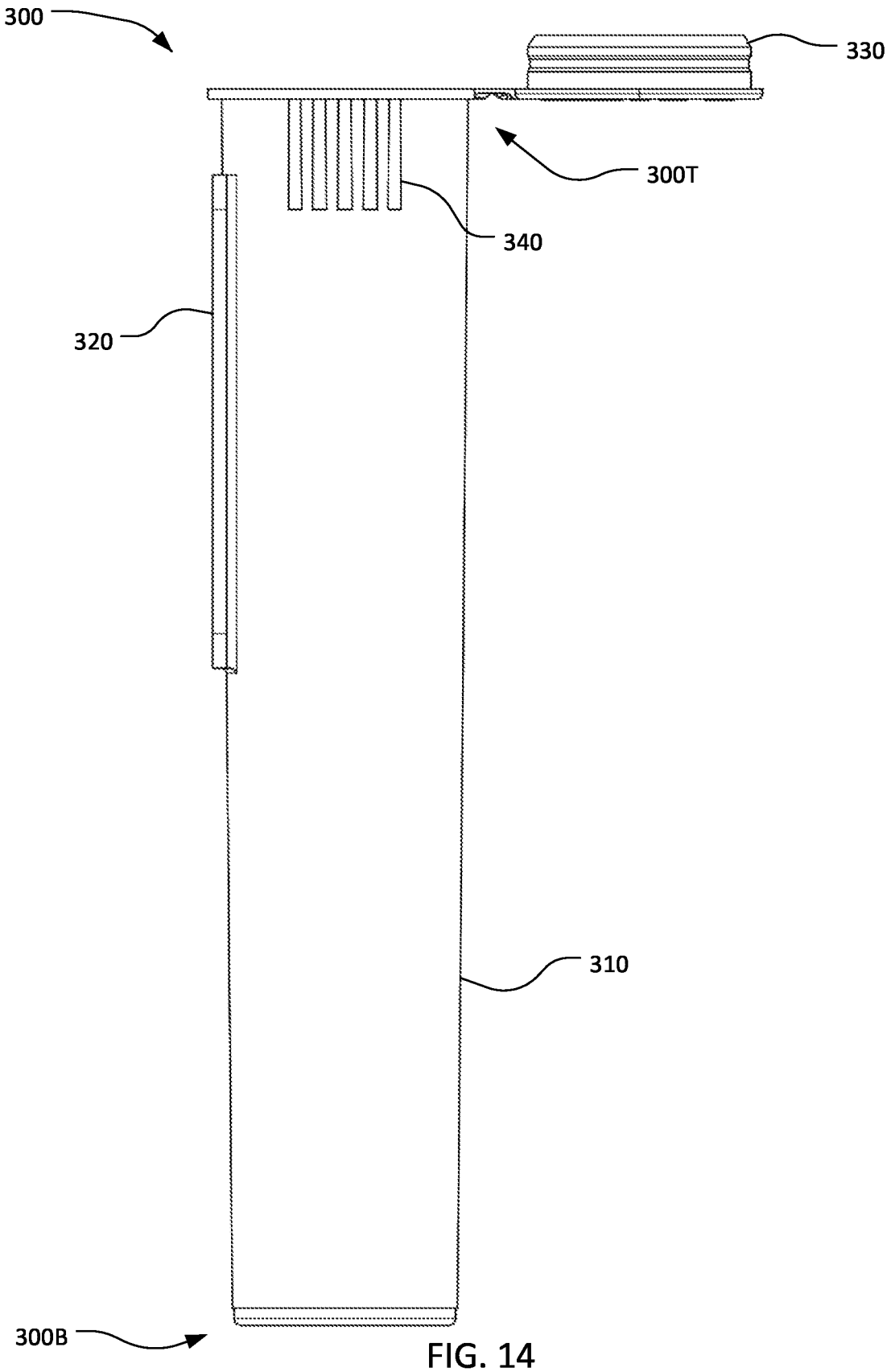
FIG. 14 is an opposite side view of the winged container of FIG. 9.
Figure 15:
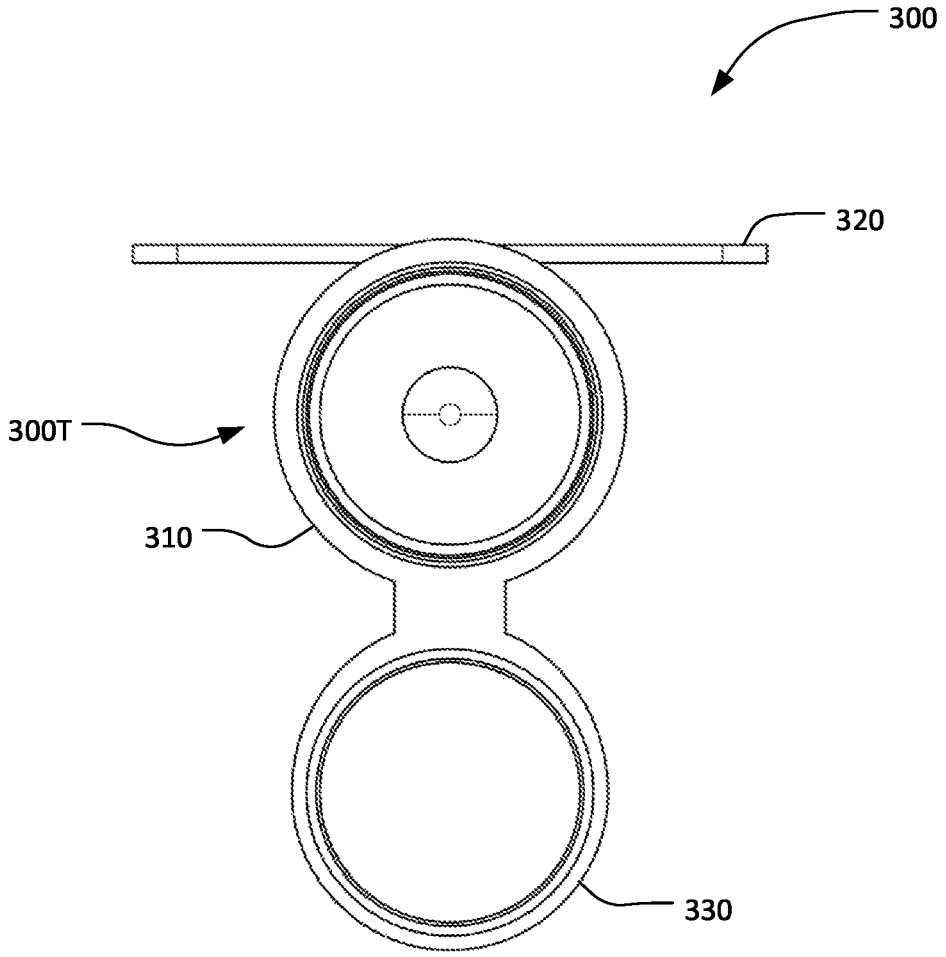
FIG. 15 is a top view of the winged container of FIG. 9.
Figure 16:
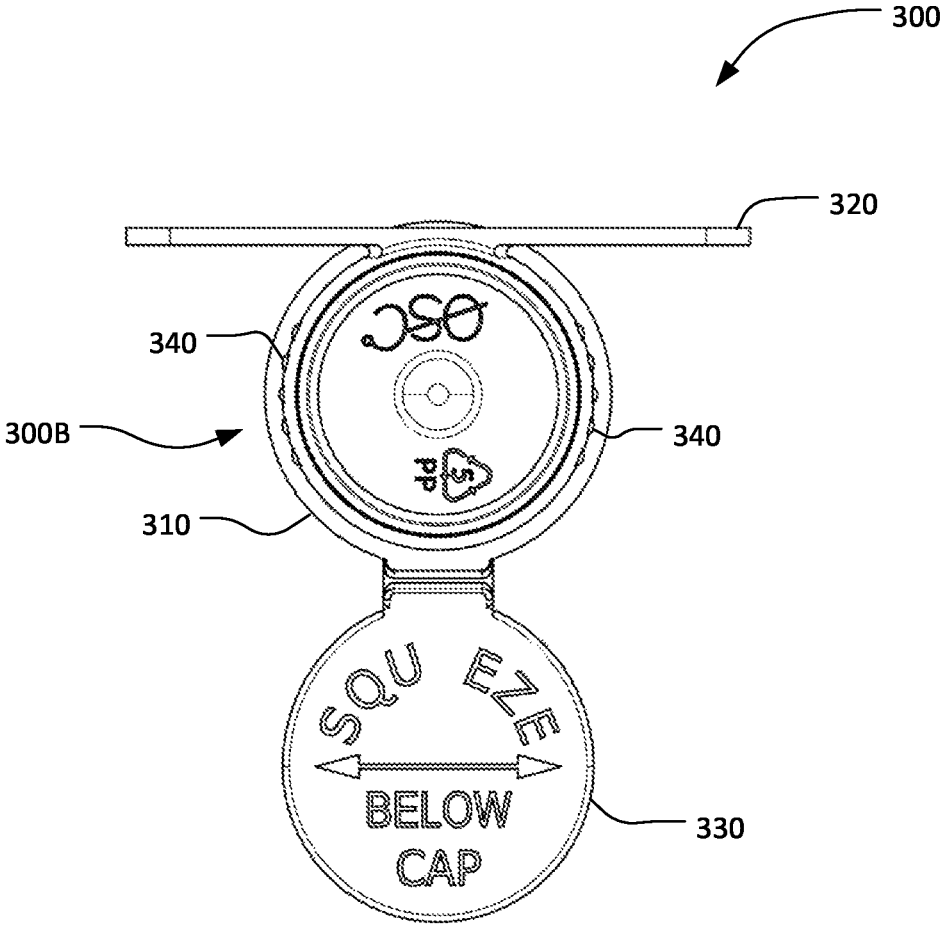
FIG. 16 is a bottom view of the winged container of FIG. 9.
Figure 17:
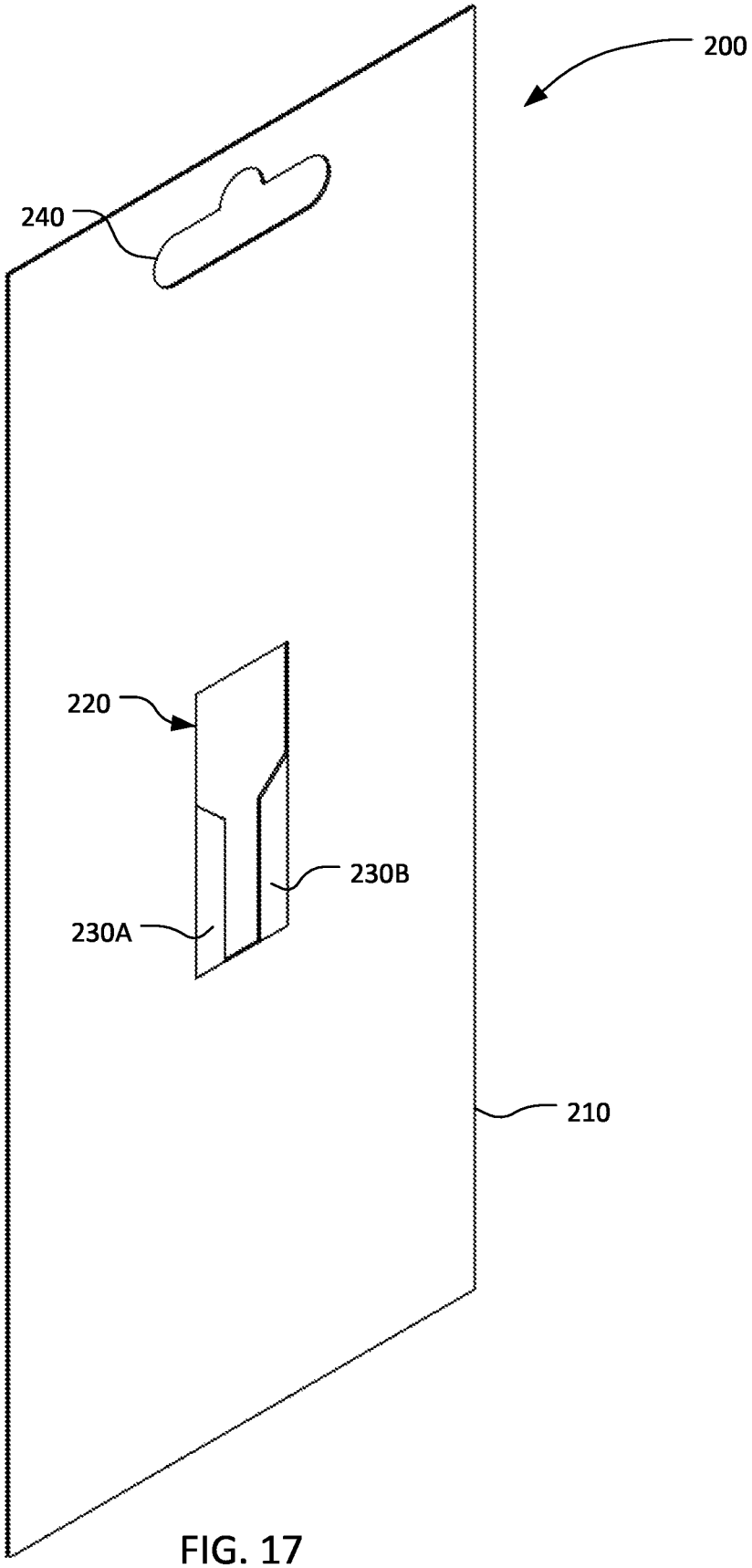
FIG. 17 is a perspective view of a slotted mounting device or holder of the winged container packaging system of FIG. 1, according to an embodiment of the disclosure.

In the illustrated embodiment, the wings 320 extend tangentially from the container body 310. The wings 320 are adjoined to the body 310 at one or more joints 350 (see FIG. 10). An upper terminal portion or a lower terminal portion of the joint(s) 350 may form a junction 300J (FIG. 10). As discussed herein, in the assembled configuration, the joint(s) 350 may abut a slot of the slotted mounting device 200 at the junction(s) 300J, and thereby facilitate securement of the container 300 to the mounting device 200.

The wings 320 depicted in the figures are square shaped and extend away from the body 310 in a symmetrical fashion. Such is merely exemplary. The wings 320 may instead be rectangular (e.g., longitudinal or latitudinally arranged), circular, oblong, triangular, cross shaped, or take on other regular or irregular shapes, and may extend from the body 310 unsymmetrically, so long as a junction 300J is formed between the body 310 and the wings 320 which abuts the slot 220 of the slotted mounting device 200 and allows the container 300 to be suspended from the mounting device 200. Where the container body 310 is tapered, the joint 350 may be correspondingly tapered. In embodiments, the wings 320 may be removably coupled to the container 300. In other embodiments, the winged container may be omitted and the wings may be removably or permanently affixed to the saleable product itself, and the winged product may be secured to the slotted mounting device 200 as described herein.

The features 340 may be, for example, ergonomic or other safety features. In an embodiment, the features 340 may be a series of ridges located near the top 300T of the body 310 and allow a consumer to securely grip the container 300. The features 340 may, in some embodiments, alternately or additionally include child safety features. For example, the features 340 may work in conjunction with the lid 330 to prevent the container 300 from opening unless operated in a specific way (e.g., by requiring the ridges 340 to be squeezed to release the lid 330). The features 340 may in embodiments be omitted.

Focus is directed now to FIGS. 17-20. The slotted mounting device 200 may comprise a board 210 having a slot 220, and optionally, a display feature 240.

The board 210 may comprise any suitable material now known or subsequently developed, such as cardstock, paper, plastic, metal, et cetera. In embodiments, the board 210 is printable (e.g., is coated with a printable coating or comprises a material that is inherently printable) and is configured to be used to advertise or display information regarding the product stored in the container 300. For example, indicia may be printed on the board 210, such as at locations where the indicia is readily visible and unobstructed by the container 300. The indicia may include text, images, or other indicia relevant to the product being packaged.

While not required, the shape and/or dimensions of the board 210 may be adapted to reflect or otherwise indicate the product in the container 300. For example, where the product stored in the container 300 is an energy drink, the board 210 may be shaped like a lightning bolt having a yellow color, and may further contain text indicating the product name, price, and/or relevant nutritional information. Or, for instance, where the product is a perfume, the board 210 may be shaped to represent an iconic shape of a perfume bottle. As another example, where the product is e-cigarette fluid, the board 210 may be shaped to represent an e-cigarette.

Figure 18:
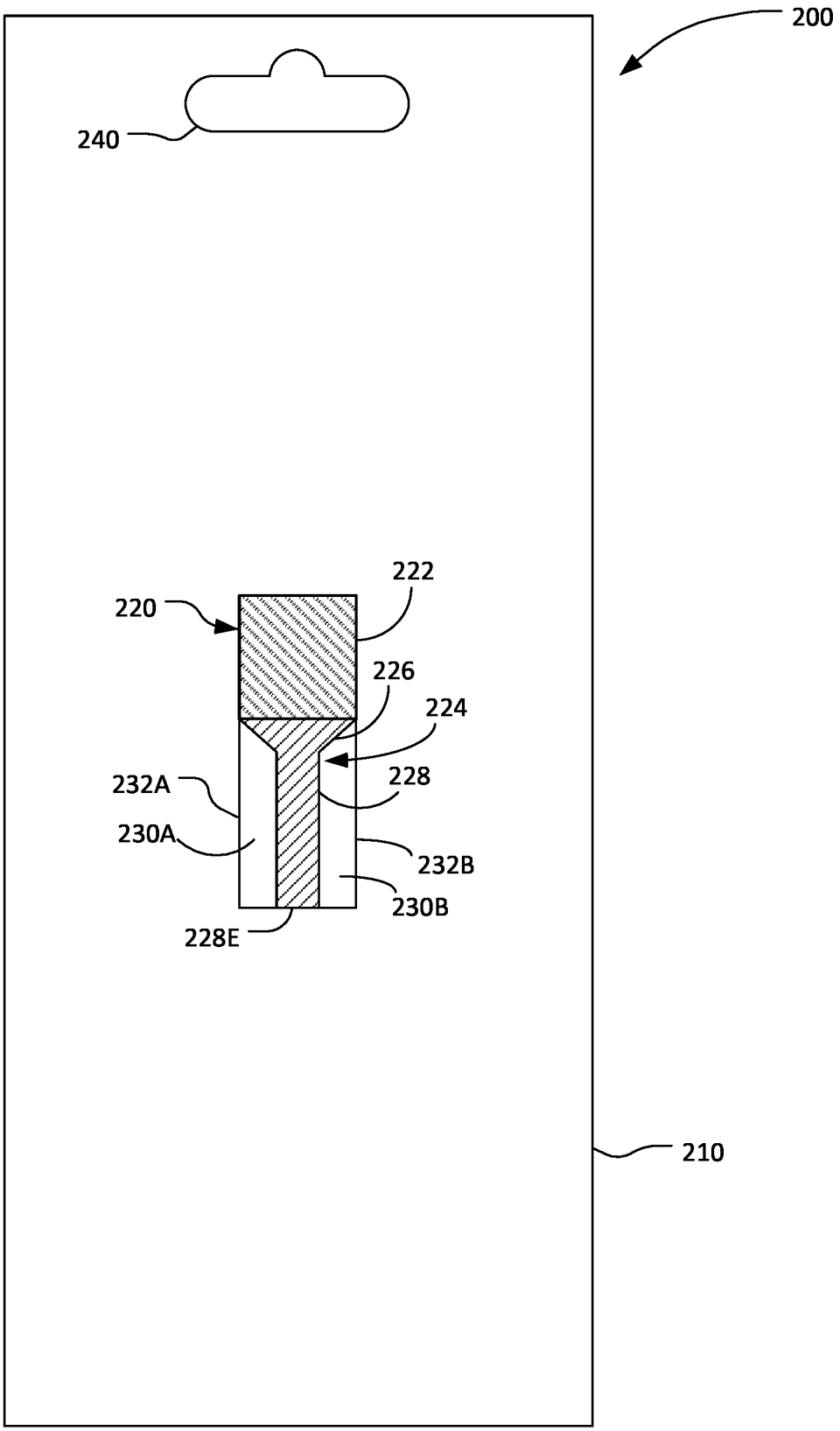
FIG. 18 is a front view of the slotted mounting device of FIG. 17.
Figure 19:
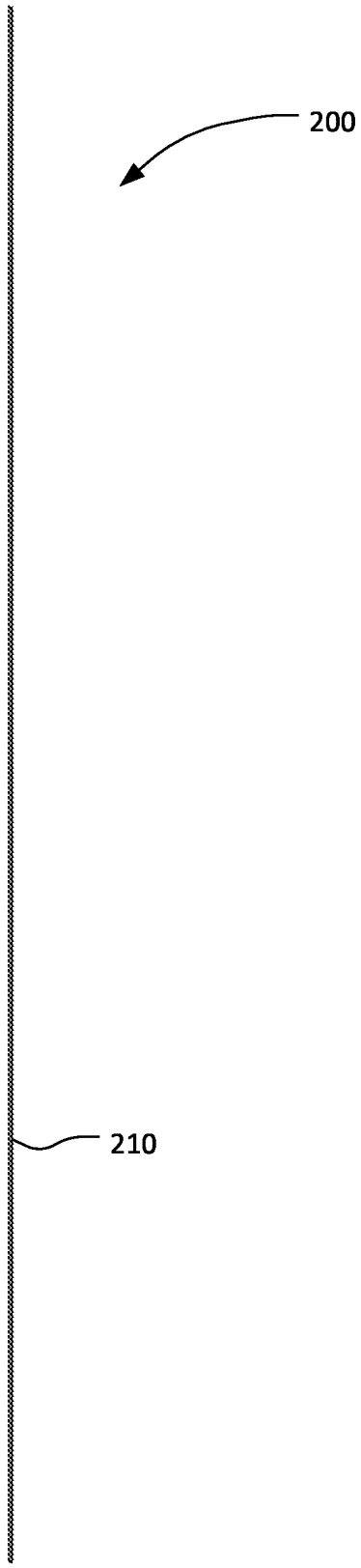
FIG. 19 is a side view of the slotted mounting device of FIG. 17.
Figure 20:
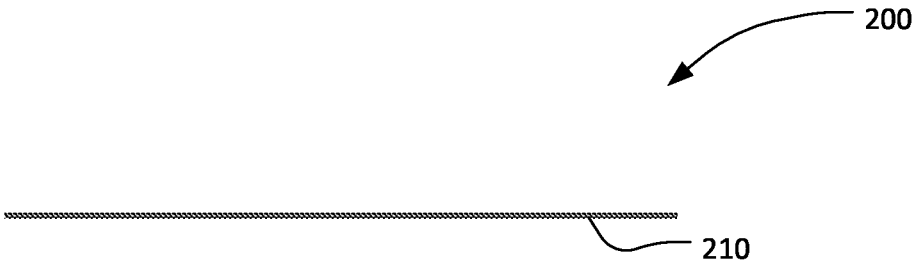
FIG. 20 is a top view of the slotted mounting device of FIG. 17.
Figure 21:
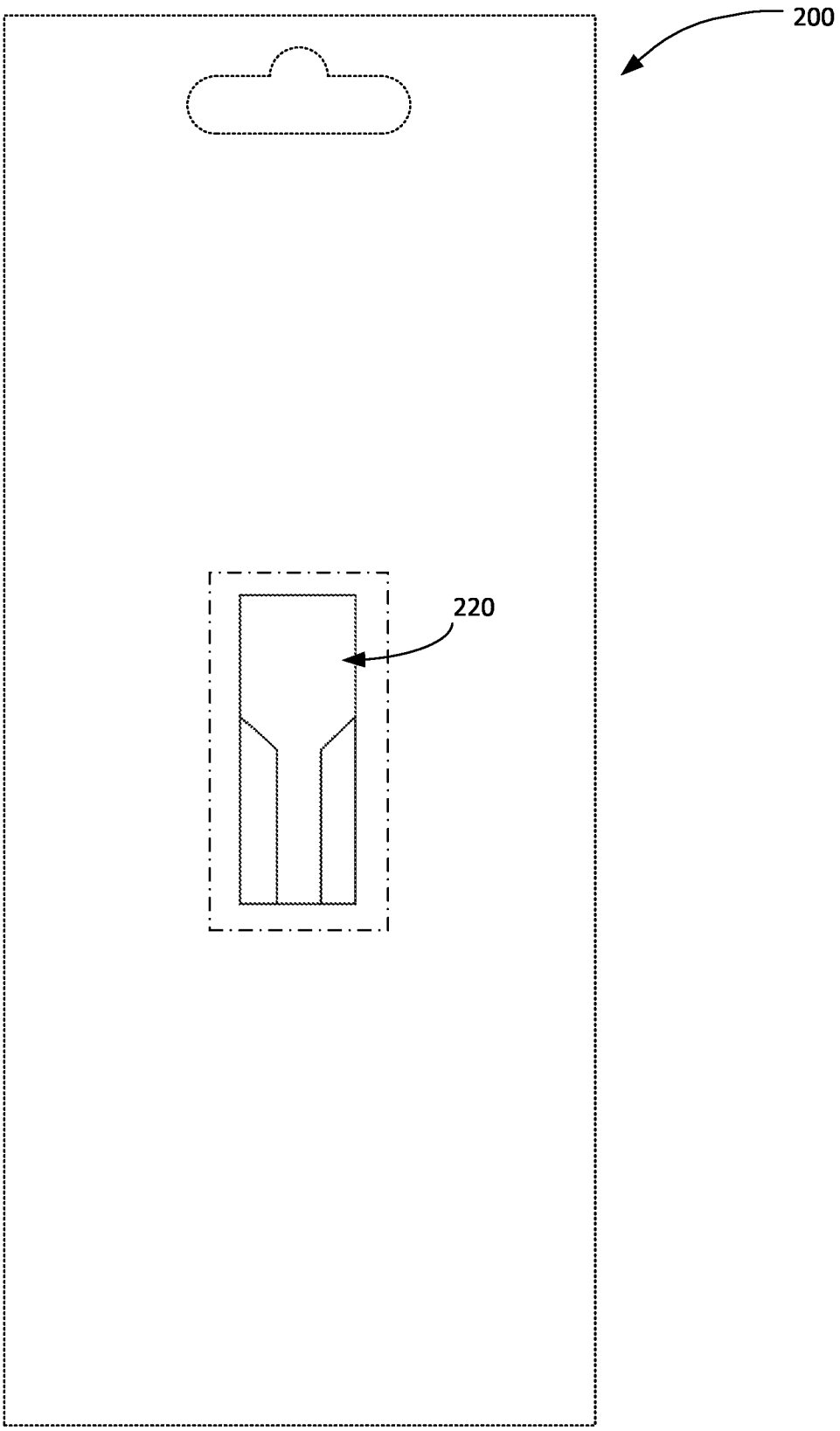
FIG. 21 is a front view of the slotted mounting device of FIG. 17 highlighting particular ornamental aspects of the slotted mounting device.

The slot 220 may also be referred to herein as an aperture, cutout, or opening. The slot 220 may be formed in or proximate the center of the board 210 or may be provided elsewhere therein. The void formed by the slot 220 is shaded in FIG. 18 to facilitate discussion. As can be seen in FIG. 18, in some examples, the slot 220 may have a generally rectangular section 222 and a generally funnel shaped section 224 that extends from the rectangular section 222 (the rectangular section 222 has shading disparate from the shading of the funnel shaped section 224 for clarity). The funnel shaped section 224 of the slot 220 may have a mouth 226 and a stem 228 that extends from the mouth 226. The stem 228 may terminate at an end 228E.

The shape and arrangement of the slot 220, and specifically the void formed by the funnel shaped section 224 thereof, may result in the board 210 having flaps 230A and 230B that extend into the slot 220 outboard the stem 228 and the mouth 226. As can be seen, flaps 230A and 230B are on opposing sides of the stem 228. Each flap 230A and 230B may be unitary and be trapezoidal or generally trapezoidal (e.g., be rectangular with a chamfered edge, where the chamfered edge corresponds to the mouth 226). Alternately, and depending on the shape and configuration of the slot 220, the flaps 230A and 230B may take on other shapes (e.g., the chamfered edge may instead be arced). The flaps 230A and 230B may also be referred to herein as "barn doors" or "appendages."

The flap 230A may be unitary with the board 210 and be foldable or angularly or rotatably displaceable along fold line 232A with respect to the remainder of the board 210.

The flap 230B may likewise be unitary with the board 210 and be foldable or angularly or rotatably displaceable along fold line 232B with respect to the remainder of the board 210. In operation, the barn doors 230A and 230B and the slot 220, together with the wings 320 of the container 300, may collectively facilitate the securement of the winged container 300 to the mounting device 200. The shape, size, and dimension of the slot 220, and resultantly the flaps 230A and 230B, may be configured so as to ensure that the winged container 300 is securely affixed to the mounting device 200 as discussed herein.

The display feature 240 may be a hang tab that allows the packaging assembly 100 to be hung at a retail location, or one or more other features that facilitate the display of the winged container packaging system 100 at the retail location.

Figure 2:
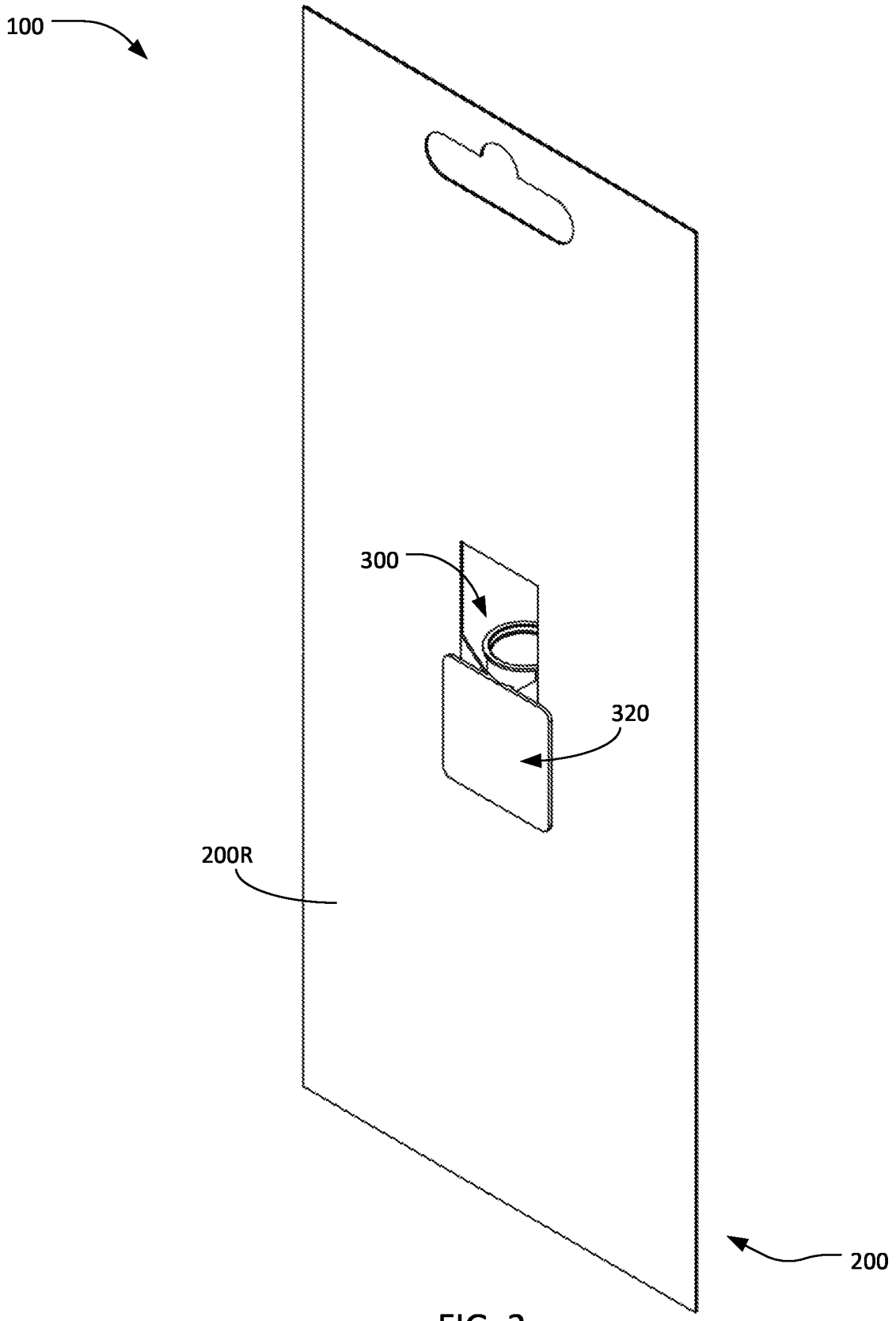
FIG. 2 is another perspective view of the winged container packaging system of FIG. 1.
Figure 3:
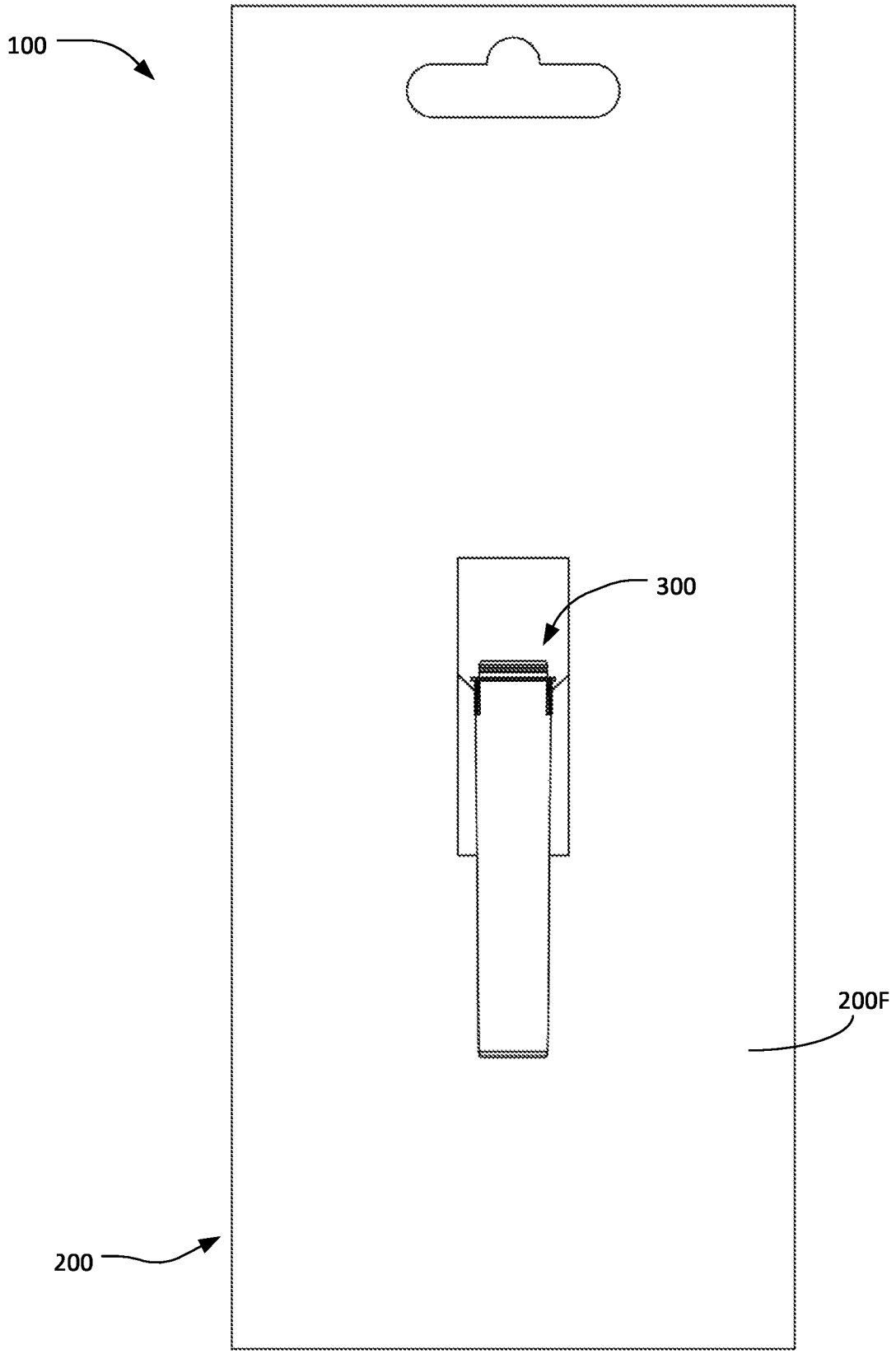
FIG. 3 is a front view of the winged container packaging system of FIG. 1.
Figure 4A:
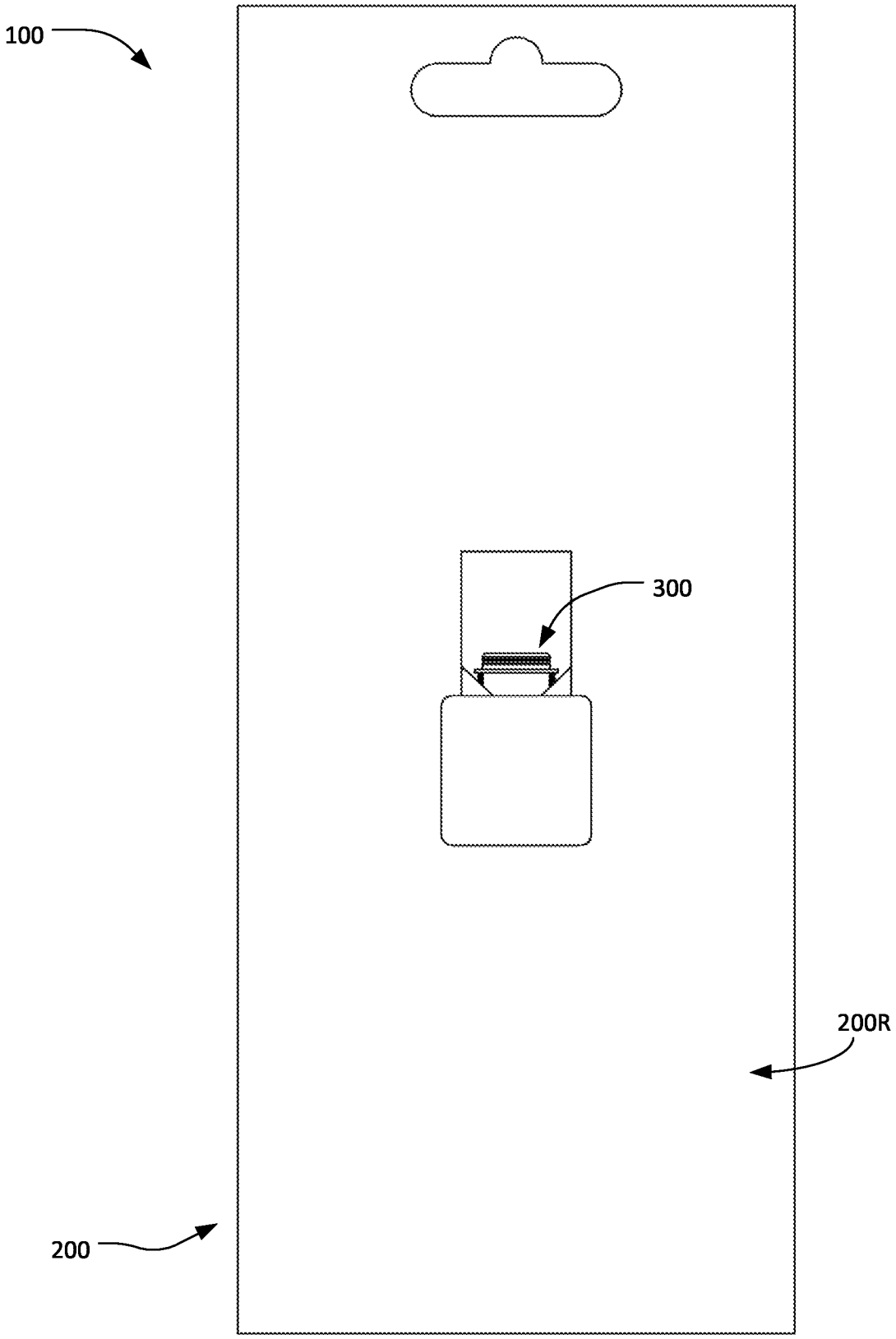
FIG. 4A is a rear view of the winged container packaging system of FIG. 1.
Figure 4B:
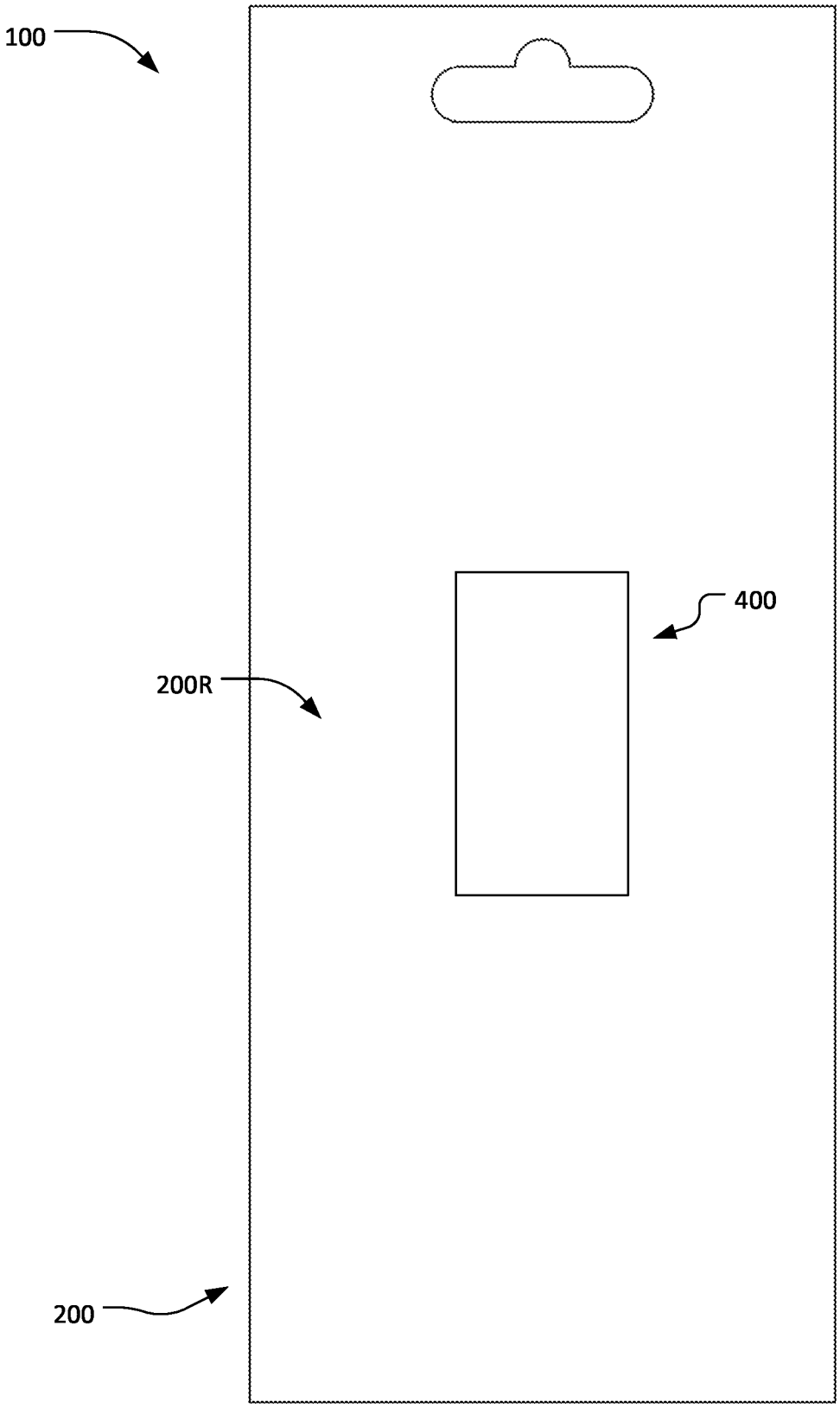
FIG. 4B is a rear view of another embodiment of the winged container packaging system of FIG. 1 having a sealing device.
Figure 5:
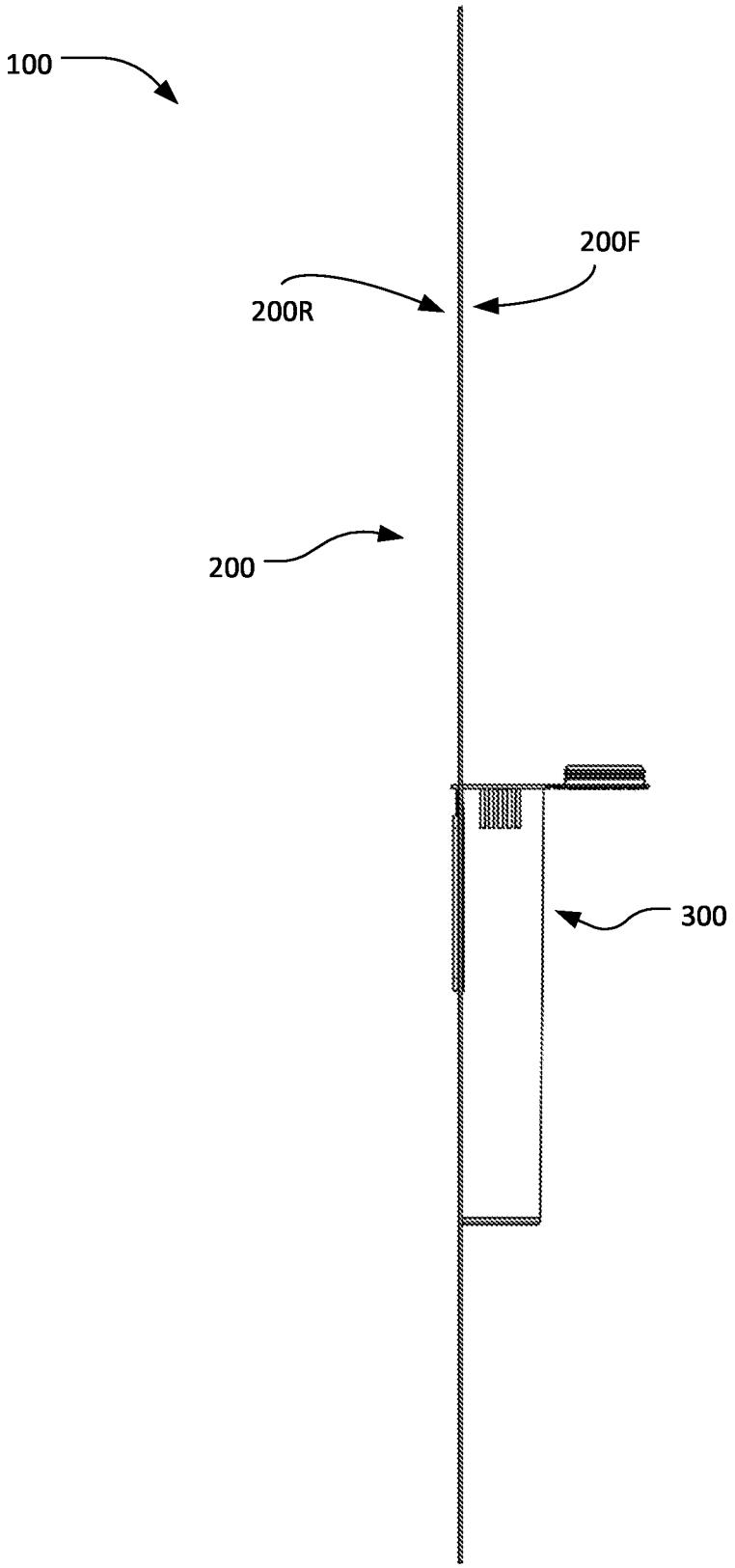
FIG. 5 is a side view of the winged container packaging system of FIG. 1.
Figure 6:
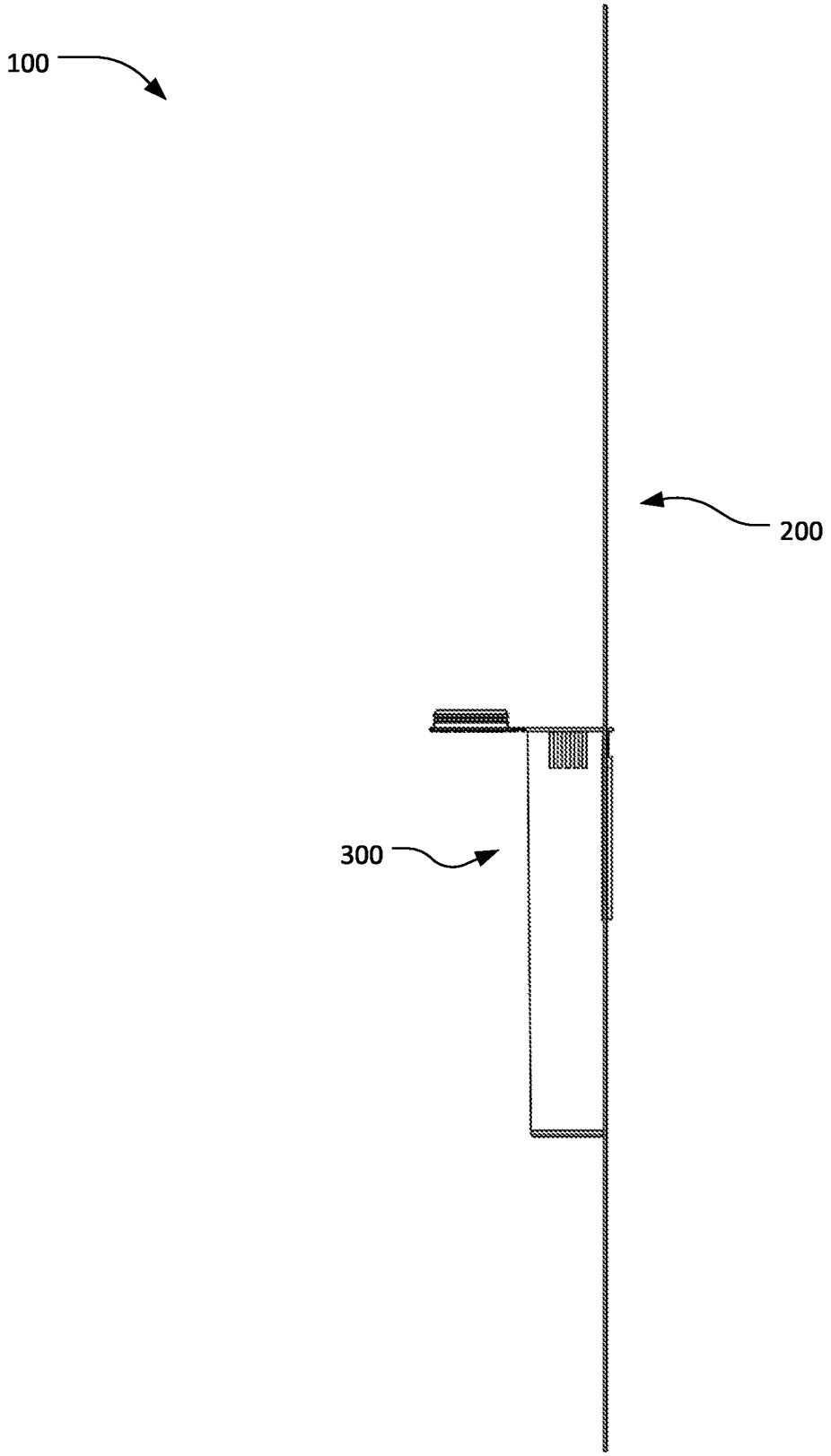
FIG. 6 is an opposite side view of the winged container packaging system of FIG. 1.
Figure 7:
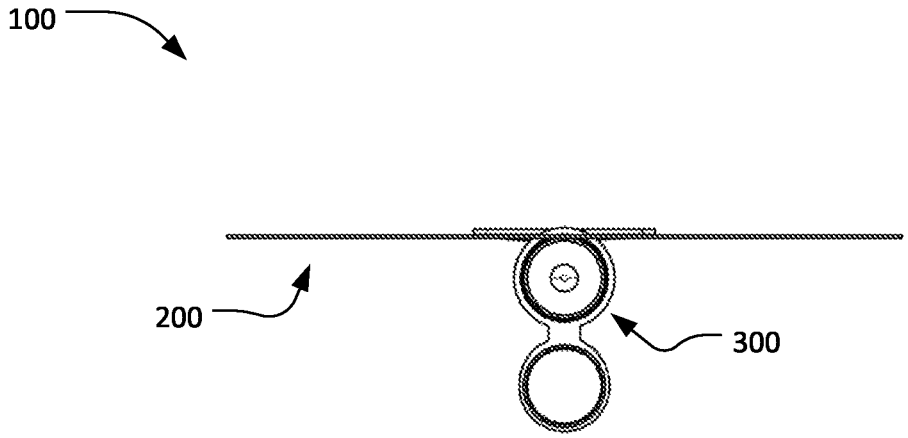
FIG. 7 is a top view of the winged container packaging system of FIG. 1.
Figure 8:
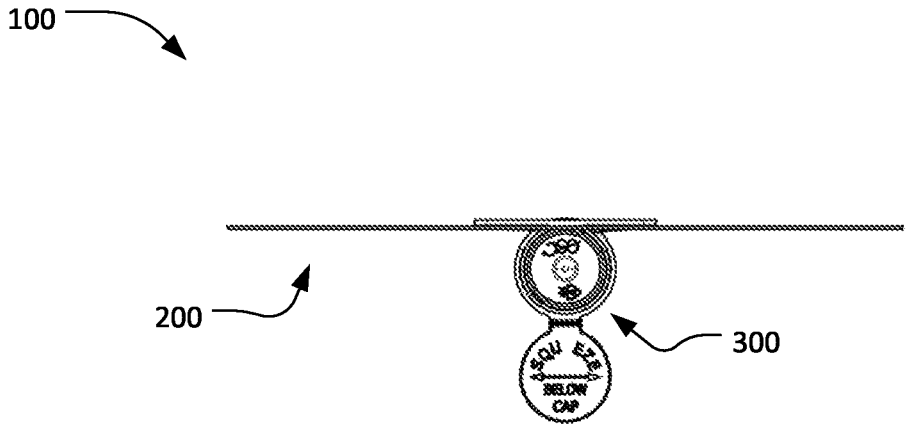
FIG. 8 is a bottom view of the winged container packaging system of FIG. 1.

FIGS. 1-8 depict the slotted mounting device 200 and the winged container 300 in an assembled configuration. FIG. 1 shows a front face 200F of the mounting device 200 and FIG. 2 shows a rear face 200R thereof. These designations 200F and 200R are merely exemplary and are demarcated to illustrate the workings of the packaging system 100 in an example orientation. In operation, either face of the mounting device 200 may be the front face 200F or the back face 200R.

Figure 23A:
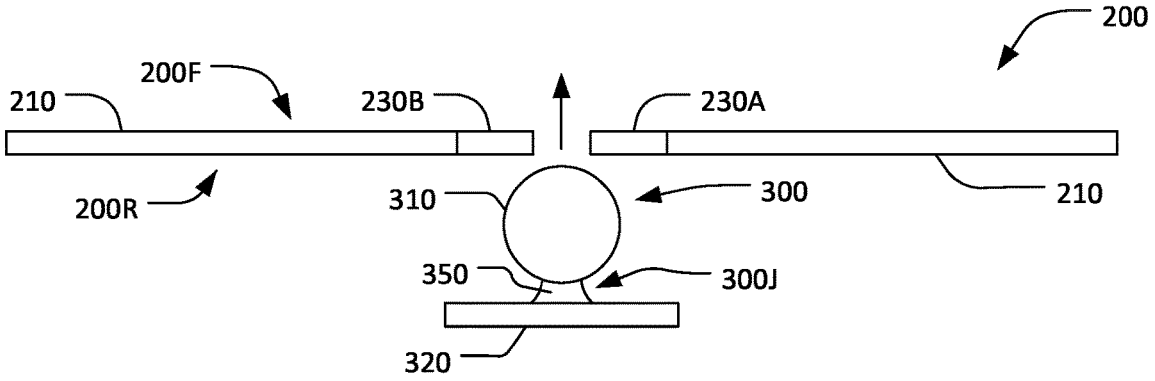
FIGS. 23A-23C are schematic views illustrating a process of assembling the winged container packaging system of FIG. 1, according to an embodiment of the disclosure.
Figure 23B:
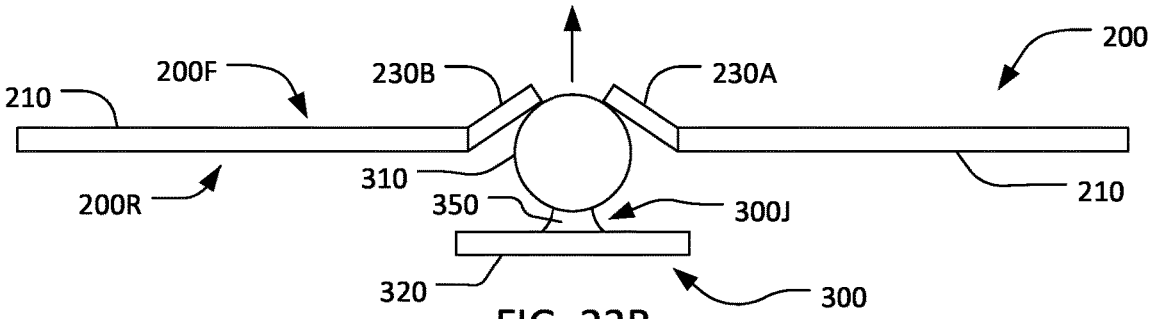
Figure 23C:
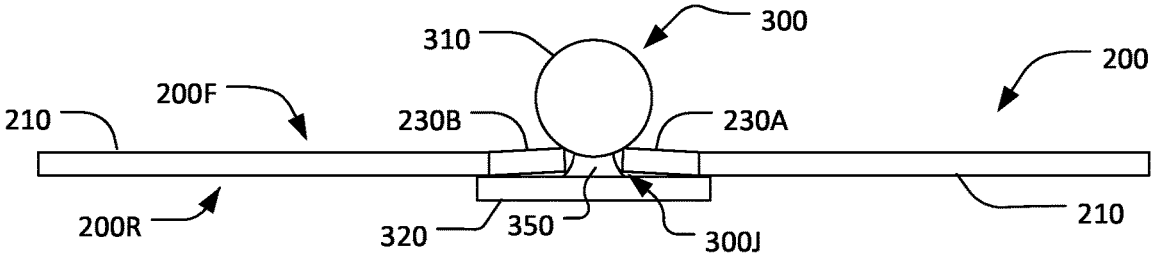

To assemble the winged container 300 with the slotted mounting device 200, the bottom 300B of the container body 310 may be passed through the slot 220 from the rear face 200R of the mounting device 200 such that the container body 310 passes through the slot 220 and is adjacent the front face 200F of the mounting device 200 while the wings 320 continue to face the rear face 200R of the mounting device 200. This process is shown in detail in FIGS. 23A-23C. As the container body 310 travels through the slot 220 towards the front face 200F (FIGS. 1 and 23A) of the mounting device 200, the body 310 may push the flaps 230A and 230B (i.e., cause the flaps 230A and 230B to rotate or pivot outwards away from the front face 200F, see FIG. 23B) to allow the container body 310 to pass through the slot 220. The flaps 230A and 230B may abut the joint 350 joining the wings 320 to the container body 310, and eventually, the container body 310 may be pushed downward to cause the joint 350 to abut the end 228E (FIG. 18) of the stem 228 of the slot 220 at the junction 300J. Such may cause the flaps 230A and 230B to rotate inwards towards their original position (FIG. 23C). The container 300 may now be locked in place by virtue of the joint 350 abutting the end 228E of the stem 228 and the flaps 230A and 230B gripping the body 310 and/or the joint 350. In embodiments, an audible "snap" or "click" may be heard as the container 300 reaches the end of its travel and the joint 350 abuts the end 228E of the stem 228 of the slot 220. The audible snap may result from the flaps 230A and 230B reaching their final position in FIG. 23C from the intermediate position shown in FIG. 23B. In implementations, in addition to or in lieu of the audible snap, the user may further get a haptic feedback when the container 300 is snapped or locked in place. The audible and/or haptic feedback may communicate to the user that the container has been appropriately secured to the mounting device 200.

In this assembled configuration, the container wings 320 may be in contact with and/or adjacent the rear face 200R of the mounting device 200 (FIG. 2), the container body 310 may be in contact with and/or adjacent the front face 200F of the mounting device 200 (FIG. 1), and the mounting device 200 may extend between the container body 310 and the wings 320.

While the container 300 may now be securely affixed to the mounting device 200, in a belt and suspenders approach, in embodiments a sealing device 400 (FIG. 4B) may be attached to wings 320 and the rear face 200R of the mounting device 200 to curtail relative movement of the container 300 with respect to the mounting device 200. In some embodiments, the sealing device 400 may alternately or additionally act as a tamper evident seal. The sealing device 400 may be, for example, one or more pieces of tape, a liquid sealant, an adhesive, a fugitive glue, one or more pieces of tac, et cetera.

Figure 22:
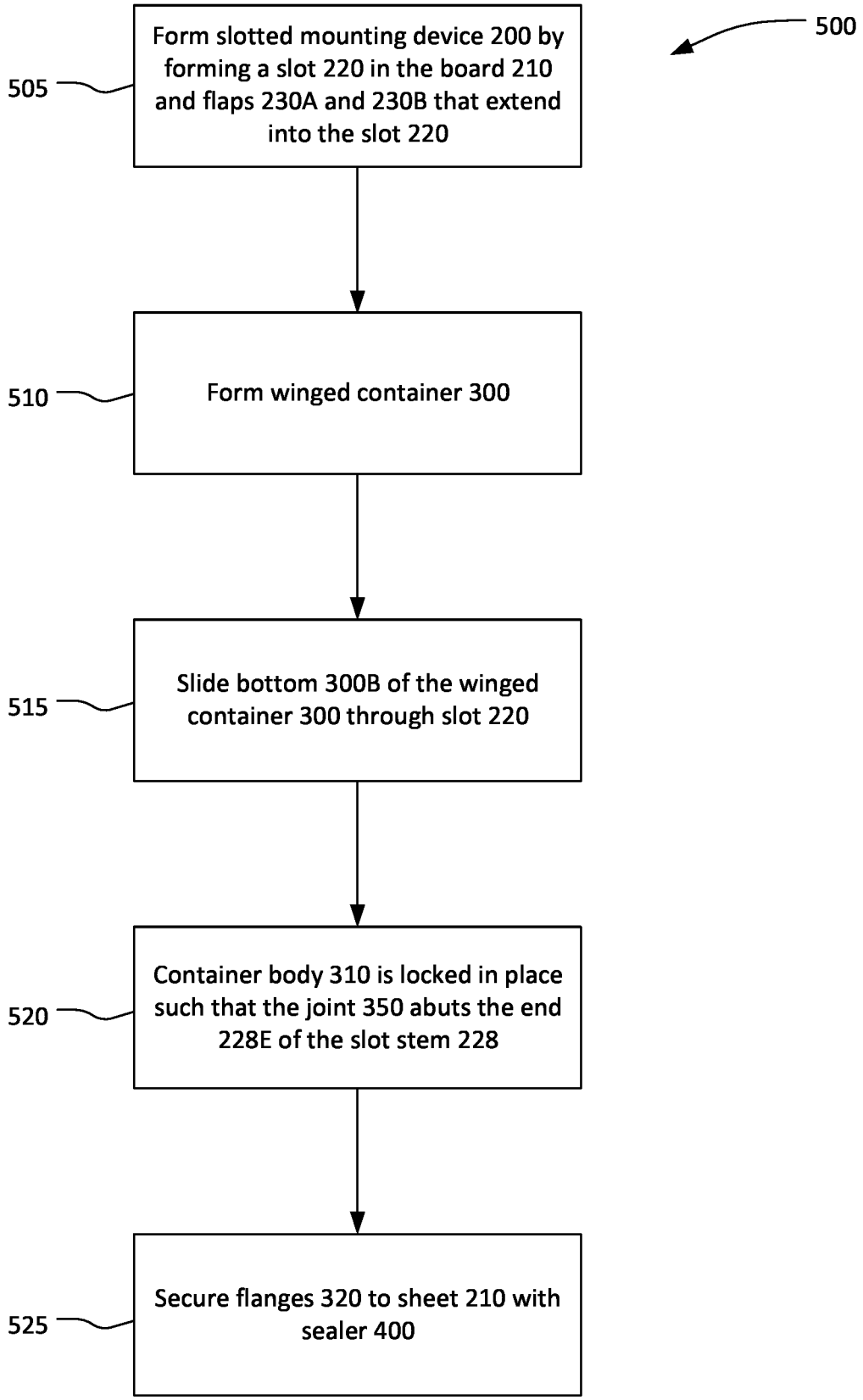
FIG. 22 is a flow chart illustrating a method of making the winged container packaging system of FIG. 1, according to an embodiment of the disclosure.

FIG. 22 is a flow chart illustrating a method 500 of making and using the winged container packaging system 100, in an embodiment. At step 505, the mounting device 200 may be created by forming within the board 210 the slot 220 having flaps 230A and 230B that extend into the slot 220. At step 510, the winged container 300 may be formed (e.g., by forming the container body 310 with integral wings 320 or by retrofitting a preexisting container body 310 with wings 320). Thereafter, the winged container 300 may be secured to the mounting device 200 at steps 515-525. This may be accomplished at step 515 by situating the container body 310 adjacent the rear face 200R of the mounting device 200 and passing it through the slot 220 such that at least a portion of the container body 310 faces the front face 200F of the mounting device 200. At step 520, the container body 310 may be locked in place such that the joint 350 abuts the end 228E of the slot stem 228 at the junction 300J. As discussed, flaps 230A and 230B may initially rotate outward as the body 310 is pushed through the slot 220 and then rotate towards their original position as the container body 310 is locked in place. At step 525, a sealing device 400 may be applied to the wings 320 and the rear face 200R to virtually eliminate relative movement of the container 300 with respect to the mounting device 200. Indicia may be located on the mounting device 200 before the winged container 300 is secured thereto to form the packaging system 100. The consumer may easily disassociate the container 300 from the slotted mounting device 200 by removing the sealing device 400 and pulling the container body 310 through the slot 220 such that the container body 310 faces the rear face 200R of the mounting device.

It is to be understood that the steps of the method 500 may be modified, added to, and/or omitted as desired, and that such considerations have been contemplated and are within the scope of the disclosure. For example, the artisan may understand that the method 500 may be readily modified by foregoing the step of adding the sealer 400 where the native securement of the container 300 to the mounting device 200 is deemed sufficient. As another example, the method 500 may be adapted to use a mounting device 600 (FIGS. 24-26) instead of the device 200, as discussed in further detail below.

Figure 24:
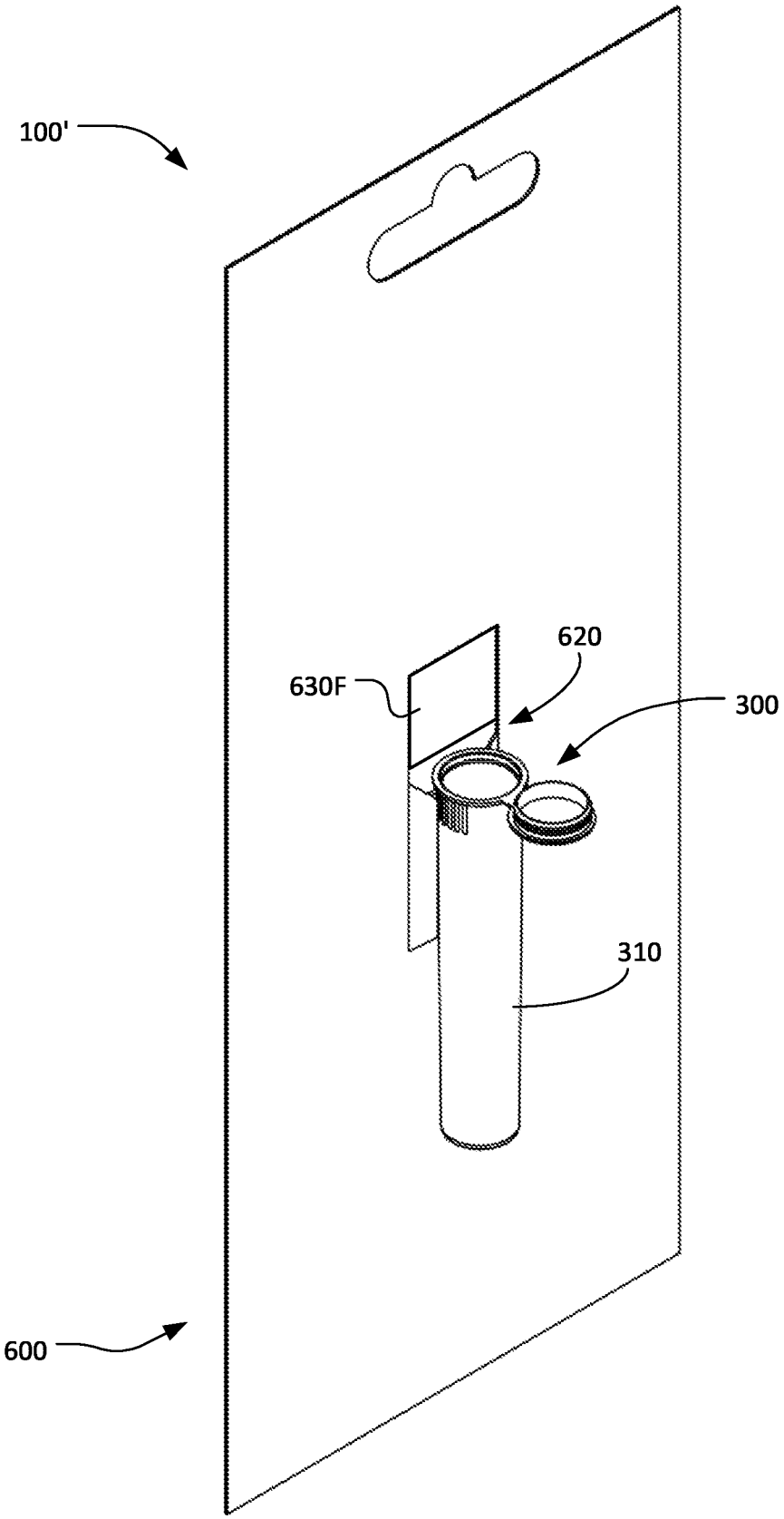
FIG. 24 is a perspective view of a winged container packaging system, according to another embodiment of the disclosure.
Figure 25:
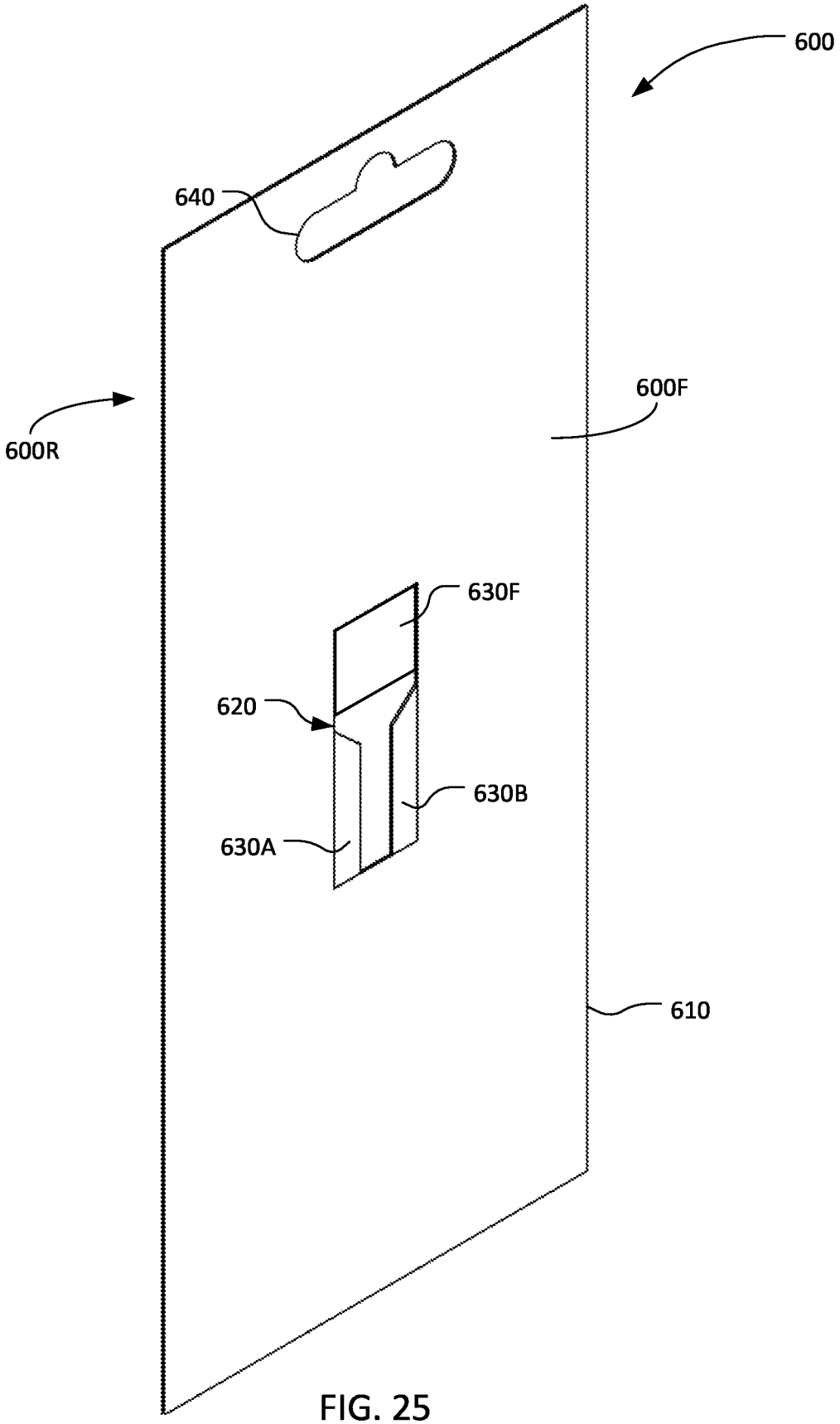
FIG. 25 is a perspective view of a slotted mounting device or holder of the winged container packaging system of FIG. 24.
Figure 26:
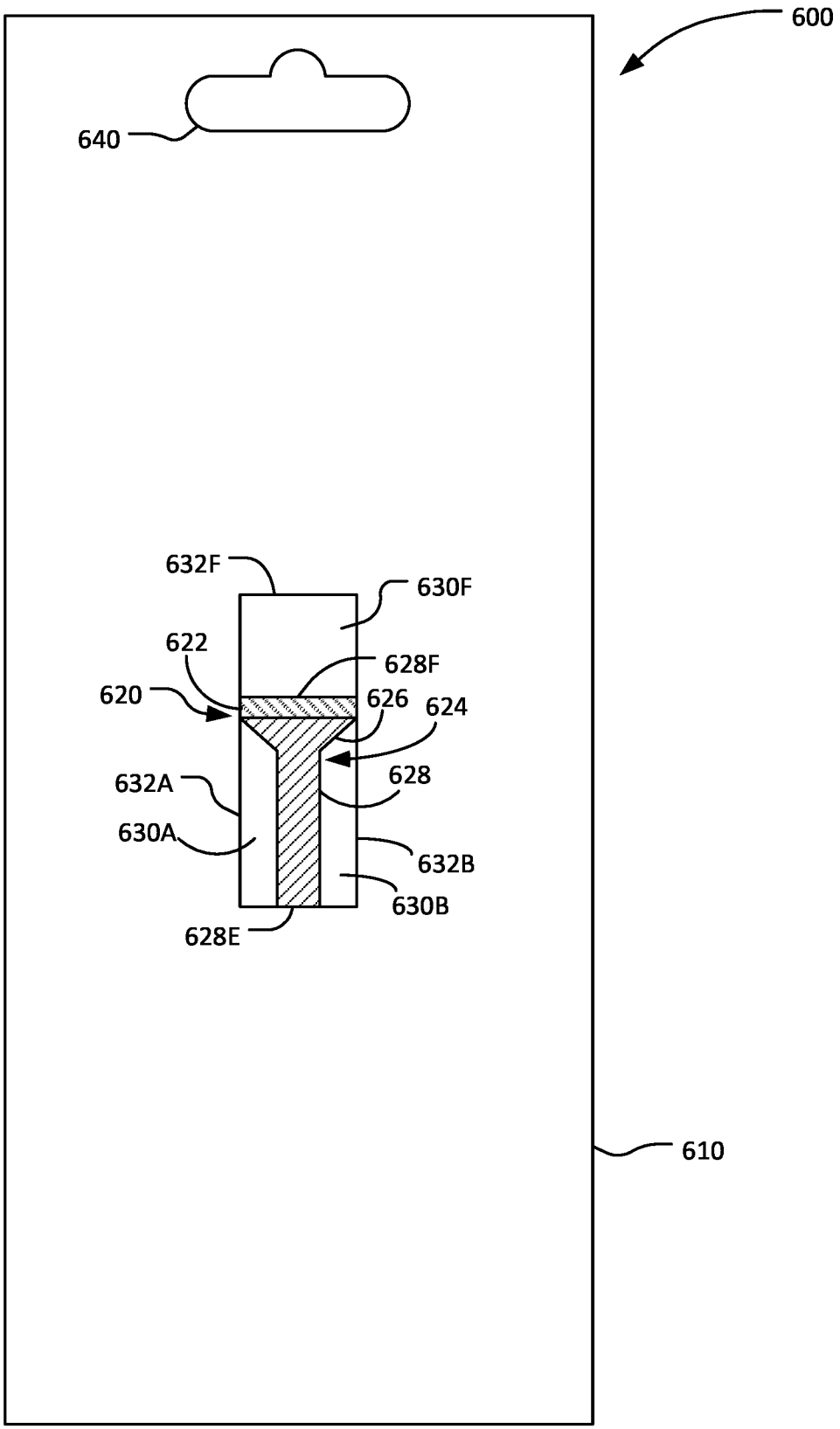
FIG. 26 is a front view of the slotted mounting device of FIG. 25.

FIGS. 24-26 depict an embodiment 100' of a winged container packaging system and components thereof, which may be substantially the same or similar to the embodiment 100, except where explicitly noted or would be implied. Part numbers beginning with "6-" may be substantially the same or similar to part numbers beginning with "2-" except where noted, described, or would be inherent. The primary difference between the embodiment 100' and the embodiment 100 is that the embodiment 100' employs a mounting device 600 in lieu of the mounting device 200 to securely retain the winged container 300. The primary difference between the mounting device 600 and the mounting device 200 may be that the mounting device 600 may comprise a flap 630F upwardly adjacent the slot 620.

FIG. 24 shows the winged container 300 secured to the mounting device 600 in an assembled configuration. FIGS. 25 and 26 show the slotted mounting device 600 in more detail, without the winged container 300 assembled therewith. In the assembled configuration, the winged container 300 may be suspended from the slotted mounting device 600 such that the mounting device 600 extends between the container body 310 and the wings 320. The packaging system 100' may be easily assembled in a matter of seconds, and the assembled system 100' may be hung or placed on a shelf for display. The mounting device 600 may provide ample real estate for indicia to be provided, e.g., for marketing, outlining directions for use, etc., while precluding or at least limiting movement of the attached container 300 (e.g., along a vertical or another axis) while the container 300 is secured to the mounting device 600.

Focus is directed now to FIGS. 25 and 26, which show a front face 600F of the slotted mounting device 600. The slotted mounting device 600 may comprise a board or sheet 610 having a slot 620, and optionally, a display feature 640.

The board 610 may comprise any suitable material now known or subsequently developed, such as cardstock, paper, plastic, metal, et cetera. In embodiments, the board 610 is printable (e.g., is coated with a printable coating or comprises a material that is inherently printable) and is configured to be used to advertise or display information regarding the product stored in the container 300. For example, indicia may be printed on the board 610, such as at locations where the indicia is readily visible and unobstructed by the container 300. The indicia may include text, images, or other indicia relevant to the product being packaged. Akin to the board 210, the shape and/or dimensions of the board 610 may be adapted to reflect or otherwise indicate the product in the container 300.

The slot 620 may be formed in or proximate the center of the board 610 or may be provided elsewhere therein. The void formed by the slot 620 is shaded in FIG. 26 to facilitate discussion. As can be seen in FIG. 26, the slot 620 may have a generally rectangular section 622 and a generally funnel shaped section 624 that extends from the rectangular section 622 (the rectangular section 622 has shading disparate from the shading of the funnel shaped section 624 for clarity). The funnel shaped section 624 of the slot 620 may have a mouth 626 and a stem 628 that extends from the mouth 626, as also described the embodiment 100. The stem 628 may terminate at an end 628E.

The shape and arrangement of the slot 620, and specifically the void formed by the funnel shaped section 624 thereof, may result in the board 610 having flaps 630A and 630B that extend into the slot 620 outboard the stem 628 and the mouth 626. The flap 630A and 630B may generally and respectively correspond to flaps 230A and 230B discussed above. Unlike the board 210, however, the board 610 may have a flap 630F upwardly adjacent the rectangular portion 622 of the slot 620.

The flap 630F may be unitary with the board 610 and be foldable or angularly displaceable along fold line 632F with respect to the remainder of the board 610. The flap 630F may limit vertical movement of the container 300 while the container 300 is assembled with the holder 600. In operation, the barn doors 630A and 630B, the flap 630F, and the slot 620, together with the wings 320 of the container 300, may collectively facilitate the securement of the winged container 300 to the mounting device 600. The shape, size, and dimension of the slot 620, and resultantly the flaps 630A, 630B, and 630F, may be configured so as to ensure that the winged container 300 is securely affixed to the mounting device 600 as discussed herein.

The display feature 640 may be a hang tab that allows the packaging assembly 100' to be hung at a retail location, or one or more other features that facilitate the display of the winged container packaging system 100' at the retail location.

To assemble the winged container 300 with the slotted mounting device 600, the bottom 300B of the container body 310 may be passed through the slot 620 from a rear face 600R of the mounting device 600 such that the container body 310 passes through the slot 620 and is adjacent the front face 600F of the mounting device 600 while the wings 320 continue to face the rear face 600R of the mounting device 600. As the container body 310 travels through the slot 620 towards the front face 600F of the mounting device 600, the body 310 may push the flaps 630A, 630B, and 630F (i.e., cause the flaps 630A, 630B, 630F to rotate outwards away from the front face 600F) to allow the container body 310 to pass through the slot 620. The flaps 630A and 630B may abut the joint 350 joining the wings 320 to the container body 310, and eventually, the container body 310 may be pushed downward to cause the joint 350 to abut the end 628E of the stem 628 of the slot 220 at the junction 300J. Such may cause the flaps 630A and 630B to rotate inwards towards and proximate their respective original positions. The flap 630F may rotate back to its original position and end up coplanar with the board 610. The container 300 may now be locked in place by virtue of the joint 350 abutting the end 628E of the stem 628 and the flaps 630A and 630B gripping the body 310 and/or the joint 350. The container 300 may be limited in its vertical travel by an end 628F (FIG. 26) of the flap 630F. In embodiments, an audible "snap" or "click" may be heard as the container 300 reaches the end of its travel and the joint 350 abuts the end 628E of the stem 628 of the slot 620. In this assembled configuration, the container wings 320 may be in contact with and/or adjacent the rear face 600R of the mounting device 600, the container body 310 may be in contact with and/or adjacent the front face 600F of the mounting device 600, and the mounting device 600 may extend between the container body 310 and the wings 320.

Thus, as has been described, the winged container packaging systems 100 and 100' described herein may provide for a packaging system that may reduce the amount of packaging waste normally associated with packaging applications (e.g., by doing away with wasteful clamshell or blister packaging). The embodiments described herein may advantageously provide a readily adaptable packaging solution that may be used with any suitable product that may fit within a container that can be supported by a mounting board. Furthermore, assembling the winged container packaging systems 100 and 100' may be relatively easy compared to prior art packaging solutions, which saves the user time, money, and effort.

The winged container packaging systems 100 and 100' disclosed herein may include or have associated therewith electronics (e.g., theft protection systems, RFID tags, et cetera). The electronics may be used to, for example, monitor the winged container packing system. In some example embodiments, processor or processors used may be configured through particularly configured hardware, such as an application specific integrated circuit (ASIC), field-programmable gate array (FPGA), etc., and/or through execution of software to allow the winged container packaging systems 100 and 100' to function in line with the requirements of a particular application.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. The steps of the methods described herein may not need to be carried out in the exact order disclosed. A skilled artisan may develop alternative means of implementing the aforementioned improvements without departing from the scope of the present disclosure.

The invention claimed is:

1. A container packaging system, comprising:

a container having a body and wings, the wings coupled to the body at a joint, the joint terminating at a junction;

a mounting device having a front face, a rear face, and a slot, the slot comprising:

a top end and a bottom end;

a first flap and a second flap spaced apart from the first flap, each of the first flap and the second flap configured to pivot when the body is passed through the slot; and a pivotable third flap extending from the top end;

wherein, the slot defines a void comprising a funnel-shaped portion that includes a stem and a mouth;

wherein, when the container is removably coupled to the mounting device:

the body faces one of the front face and the rear face and the wings face the other of the front face and the rear face;

the first flap and the second flap are in contact with the body; and the junction is in contact with the bottom end.

2. The container packaging system of claim 1, wherein the third flap is spaced apart from the body when the container is removably coupled to the mounting device.

3. The container packaging system of claim 1, wherein the mounting device includes a hanging feature configured for hanging the mounting device.

4. The container packaging system of claim 1, wherein the container is a pop top container.

5. The container packaging system of claim 1, wherein the container is suspended from the mounting device.

6. The container packaging system of claim 1, wherein the junction extends along at least a portion of a length of the body.

7. A container packaging system, comprising:

a container having a body and wings, the wings coupled to the body at a joint, the joint terminating at a junction; and a mounting device having a front face, a rear face, and a slot, the slot including at least a first flap, a second flap, and a third flap, at least one of the first flap, the second flap, and the third flap configured to pivot from an original position and contact the body when the container is removably coupled to the mounting device;

wherein, the slot defines a void comprising a funnel-shaped portion that includes a stem and a mouth;

wherein, when the container is removably coupled to the mounting device, the body faces one of the front face and the rear face and the wings face the other of the front face and the rear face.

8. The container packaging system of claim 7, wherein the first flap opposes the second flap.

9. The container packaging system of claim 7, wherein:

a shape of the first flap is the same as a shape of a second flap; and a shape of the third flap is disparate from the shape of the first flap.

10. The container packaging system of claim 7, wherein the wings are generally rectangular.

11. The container packaging system of claim 7, wherein the first flap has a chamfered edge.

12. The container packaging system of claim 7, wherein at least one of an audible snap and a haptic signal is generated to indicate to a user that the container is locked to the mounting device.

13. The container packaging system of claim 7, wherein the container body is tubular and includes a pop top lid.

14. A container packaging system configured to removably house a container having a body and wings, the container packaging system comprising:

a mounting device having a front face, a rear face, and a slot, the slot comprising:

a top end and a bottom end;

a first flap and a second flap spaced apart from the first flap, each of the first flap and the second flap configured to pivot when the body is passed through the slot; and a pivotable third flap extending from the top end;

wherein, the slot defines a void comprising a funnel-shaped portion that includes a stem and a mouth.

15. The container packaging system of claim 14, wherein the first flap has an angled edge.

16. The container packaging system of claim 14, wherein the first flap opposes the second flap.

17. The container packaging system of claim 16, wherein the third flap is disposed above each of the first flap and the second flap.

* * * * *